US007383895B2

(12) United States Patent
Aoki

(10) Patent No.: US 7,383,895 B2
(45) Date of Patent: Jun. 10, 2008

(54) IMPACT POWER TOOL

(75) Inventor: Yonosuke Aoki, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/504,032

(22) Filed: Aug. 15, 2006

(65) Prior Publication Data

US 2007/0039749 A1 Feb. 22, 2007

(30) Foreign Application Priority Data

Aug. 19, 2005 (JP) ..... 2005-239118
Aug. 29, 2005 (JP) ..... 2005-247679

(51) Int. Cl.
*B25D 17/24* (2006.01)

(52) U.S. Cl. ..... 173/201; 173/48; 173/109; 173/162.2; 173/210

(58) Field of Classification Search ..... 173/201, 173/210, 211, 212, 162.1, 109, 162.2, 48, 173/114
See application file for complete search history.

(56) References Cited

U.S. PATENT DOCUMENTS 4,478,293 A * 10/1984 Weilenmann et al. .... 173/162.2
4,567,951 A * 2/1986 Fehrle et al. ..... 173/201
5,678,641 A 10/1997 Manschitz et al.
5,775,440 A * 7/1998 Shinma ..... 173/109
5,873,418 A * 2/1999 Arakawa et al. ..... 173/212
5,975,217 A 11/1999 Frenzel et al.
6,112,830 A * 9/2000 Ziegler et al. ..... 173/109
6,116,352 A * 9/2000 Frauhammer et al. ..... 173/212
6,237,699 B1 * 5/2001 Plietsch et al. ..... 173/201
6,644,418 B2 * 11/2003 Haga ..... 173/48
6,675,908 B1 1/2004 Frauhammer et al.
6,907,943 B2 * 6/2005 Ikuta ..... 173/117
6,913,088 B2 * 7/2005 Berger ..... 173/48
6,938,705 B2 * 9/2005 Kikuchi ..... 173/201
7,040,413 B2 * 5/2006 Mueller et al. ..... 173/13
2002/0050191 A1 5/2002 Bongers et al.
2002/0125023 A1 9/2002 Bernhart et al.
2004/0177981 A1 9/2004 Berger et al.
2006/0076154 A1 4/2006 Aoki

FOREIGN PATENT DOCUMENTS

DE 815 179 C 10/1951
EP 0 680 807 A1 11/1995
EP 0 876 880 A2 11/1998

(Continued)

*Primary Examiner*—Scott A. Smith
(74) *Attorney, Agent, or Firm*—Oliff & Berridge, PLC

(57) ABSTRACT

It is an object of the invention to provide an improved technique for lessening an impact force caused by rebound of a tool bit after the striking movement of the tool bit. Representative impact power tool (101) includes a tool body (103), a hammer actuating member (119, 145), a driving mechanism (113, 115), a weight (163) and an elastic element (165). A reaction force that the hammer actuating member receives from the workpiece when performing a hammering operation is transmitted from the hammer actuating member to the weight (163) and then, the weight (163) is caused to move rearward to push the elastic element (165). As a result, the reaction force can be absorbed by the elastic element (165). The elastic force of the elastic element (165) is prevented from acting upon the weight (163) forward beyond the reaction force transmitting position.

11 Claims, 17 Drawing Sheets

FOREIGN PATENT DOCUMENTS

| | | | |
|---|---|---|---|
| EP | 1 147 861 | A2 | 10/2001 |
| EP | 1 238 759 | A1 | 9/2002 |
| EP | 1 464 449 | A | 10/2004 |
| FR | 2 315 326 | A | 1/1977 |
| JP | A 52-109673 | | 9/1977 |
| JP | A 08-318342 | | 12/1996 |
| SU | 983266 | | 1/1980 |
| WO | WO 01/05558 | A | 1/2001 |
| WO | WO 03/024672 | A | 3/2003 |

* cited by examiner

IMPACT POWER TOOL

BACKGROUND OF THE INVENTION

1. Field of the Invention

The present invention relates to an impact power tool for performing a linear hammering operation on a workpiece and more particularly, to a technique for cushioning a reaction force received from the workpiece during hammering operation.

2. Description of the Related Art

Japanese non-examined laid-open Patent Publication No. 8-318342 discloses a technique for cushioning an impact force caused by rebound of a tool bit after an striking movement within a hammer drill. In the known hammer drill, a rubber ring (cushion member) is disposed between the axial end surface of a cylinder on the body side and an intermediate element in the form of an impact bolt which strikes the tool bit. When the tool bit receives a reaction force from the workpiece and rebounds after striking movement of the tool bit, the impact bolt collides with the rubber ring. At this time, the rubber ring cushions the impact force by elastic deformation. Further, the rubber ring also functions as a member for positioning the hammer drill body with respect to the workpiece during hammer operation. During the striking movement of the tool bit, the tip end of the tool bit is held pressed against the workpiece (the tool bit is held in its striking position) by application of the user's pressing force forward to the hammer drill body. The cylinder on the body side receives the pressing force via the rubber ring.

As described above, the known rubber ring has a function of cushioning the impact force caused by rebound of the tool bit and a function of positioning the hammer drill. In order to absorb the rebound of the tool bit, it is advantageous for the rubber ring to be soft. On the contrary, in order to improve the positioning accuracy, it is advantageous for the rubber ring to be hard. In other words, two different properties are demanded of the known rubber ring. It is difficult to provide the rubber ring with a hardness that satisfies the both functional requirements. In this point, further improvement is required.

SUMMARY OF THE INVENTION

Accordingly, it is an object of the invention to provide an improved technique for lessening an impact force caused by rebound of a tool bit after the striking movement of the tool bit.

The above-described object can be achieved by the features of claimed invention. The representative impact power tool according to the present invention includes a tool body, a hammer actuating member, an air spring and a driving mechanism. The driving mechanism linearly drives the hammer actuating member by utilizing the air spring. The hammer actuating member is disposed in a tip end region of the tool body and performs a predetermined hammering operation on a workpiece by reciprocating movement in its axial direction. The "predetermined hammering operation" in this invention includes not only a hammering operation in which the hammer actuating member performs only a linear striking movement, but a hammer drill operation in which it performs a linear striking movement and a rotation in the circumferential direction. The "hammer actuating member" typically comprises a tool bit and an impact bolt that transmits a striking force in the state of contact with the tool bit.

The representative impact power tool according to the invention further includes a weight, an elastic element and a control member. The hammer actuating member receives a reaction force from the workpiece when performing a hammering operation on the workpiece. The reaction force is transmitted from the hammer actuating member to the weight in a reaction force transmitting position. The reaction force transmitting position is defined by a position where the weight is placed in direct contact with the hammer actuating member or the weight is placed in contact with the hammer actuating member via an intervening member made of hard metal. When the weight is caused to move rearward from the reaction force transmitting position by the reaction force transmitted to the weight to push the elastic element, the elastic element is elastically deformed and absorbs the reaction force.

During hammering operation, the hammer actuating member is caused to rebound by receiving the reaction force of the workpiece after striking movement. According to the invention, with the construction in which the reaction force is transmitted from the hammer actuating member to the weight located in the reaction force transmitting position, the reaction force can be approximately 100% transmitted. In other words, the reaction force is transmitted by exchange of momentum between the hammer actuating member and the weight. By this transmission of the reaction force, the weight is caused to move rearward in the direction of action of the reaction force. The rearward moving weight elastically deforms the elastic element and absorbed by such elastic deformation. As a result, vibration of the impact power tool can be reduced.

Further, according to the invention, the control member prevents an elastic force of the elastic element from acting upon the weight forward beyond the reaction force transmitting position. As a result of such control member, when the user applies a pressing force forward to the tool body during striking movement, unnecessary force for holding the hammer actuating member is not required even with a provision of the elastic element for absorbing the reaction force. Unlike the construction such as an idle driving prevention mechanism in which a forward spring force normally acts upon the hammer actuating member, an efficient mechanism can be realized which can absorb a reaction force and in which the elastic force for absorbing the reaction force has no adverse effect when the user presses the hammer actuating member against the workpiece to place the hammer actuating member in a striking position.

Specifically, the control member may comprise a stopper that contacts the weight to prevent the weight from moving forward beyond the reaction force transmitting position.

Further, the representative impact power tool may include an idle driving prevention mechanism in addition to the above-described construction. Specifically, the impact power tool according to the invention may include an air spring actuation member and a biasing member. The air spring actuation member may be switched between a non-actuating position in which the air spring is disabled to operate and an actuating position in which the air spring is enabled to operate. The biasing member may bias the air spring actuation member to be placed in the non-actuating position.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved impact power tools and method for using such impact power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Representative Embodiment

Figure 1:
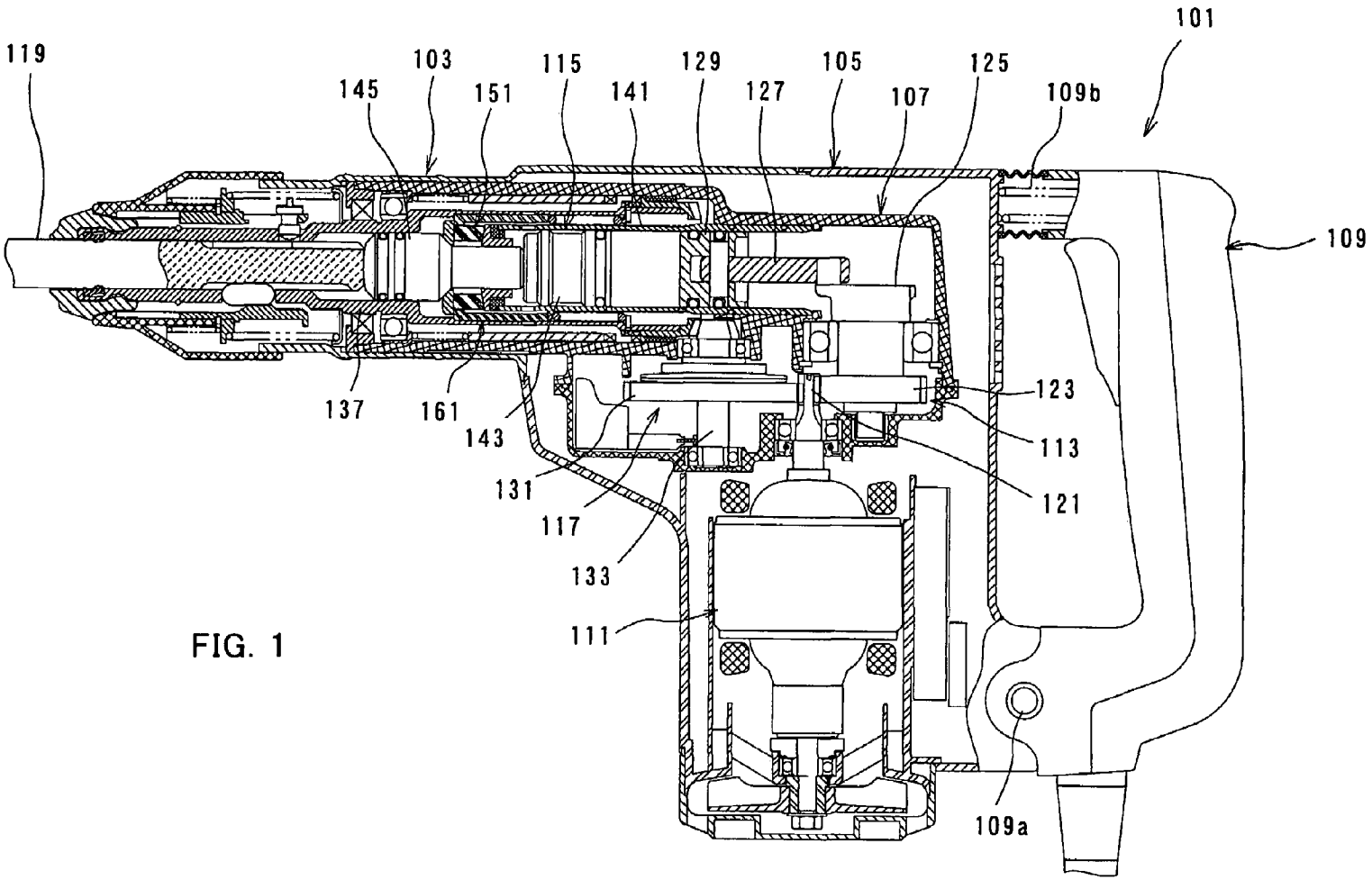
FIG. 1 is a sectional side view schematically showing an entire electric hammer drill according to a first embodiment of this invention, under loaded conditions in which a hammer bit is pressed against a workpiece.

A first representative embodiment of the present invention is now described with reference to FIGS. 1 to 5. FIG. 1 is a sectional side view showing an entire electric hammer drill 101 as a first representative embodiment of the impact power tool according to the invention, under loaded conditions in which a hammer bit is pressed against a workpiece.

As shown in FIG. 1, the hammer drill 101 includes a body 103, a hammer bit 119 detachably coupled to the tip end region (on the left side as viewed in FIG. 1) of the body 103 via a tool holder 137, and a handgrip 109 that is held by a user and connected to the rear end region (on the right side as viewed in FIG. 1) of the body 103. The body 103 is a feature that corresponds to the "tool body" according to the present invention. The hammer bit 119 is held by the tool holder 137 such that it is allowed to reciprocate with respect to the tool holder 137 in its axial direction and prevented from rotating with respect to the tool holder 137 in its circumferential direction. The hammer bit 119 is a feature that corresponds to the "tool bit" according to the present invention. In the present embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a motion converting mechanism 113, a power transmitting mechanism 117 and a striking mechanism 115. The motion converting mechanism 113 is adapted to appropriately convert the rotating output of the driving motor 111 to linear motion and then to transmit it to the striking mechanism 115. As a result, an impact force is generated in the axial direction of the hammer bit 119 via the striking mechanism 115. Further, the speed of the rotating output of the driving motor 111 is appropriately reduced by the power transmitting mechanism 117 and then transmitted to the hammer bit 119. As a result, the hammer bit 119 is caused to rotate in the circumferential direction. The handgrip 109 is generally U-shaped in side view, having a lower end and an upper end. The lower end of the handgrip 109 is rotatably connected to the rear end lower portion of the motor housing 105 via a pivot 109*a*, and the upper end is connected to the rear end upper portion of the motor housing 105 via an elastic spring 109*b* for absorbing vibration. Thus, the transmission of vibration from the body 103 to the handgrip 109 is reduced.

Figure 2:
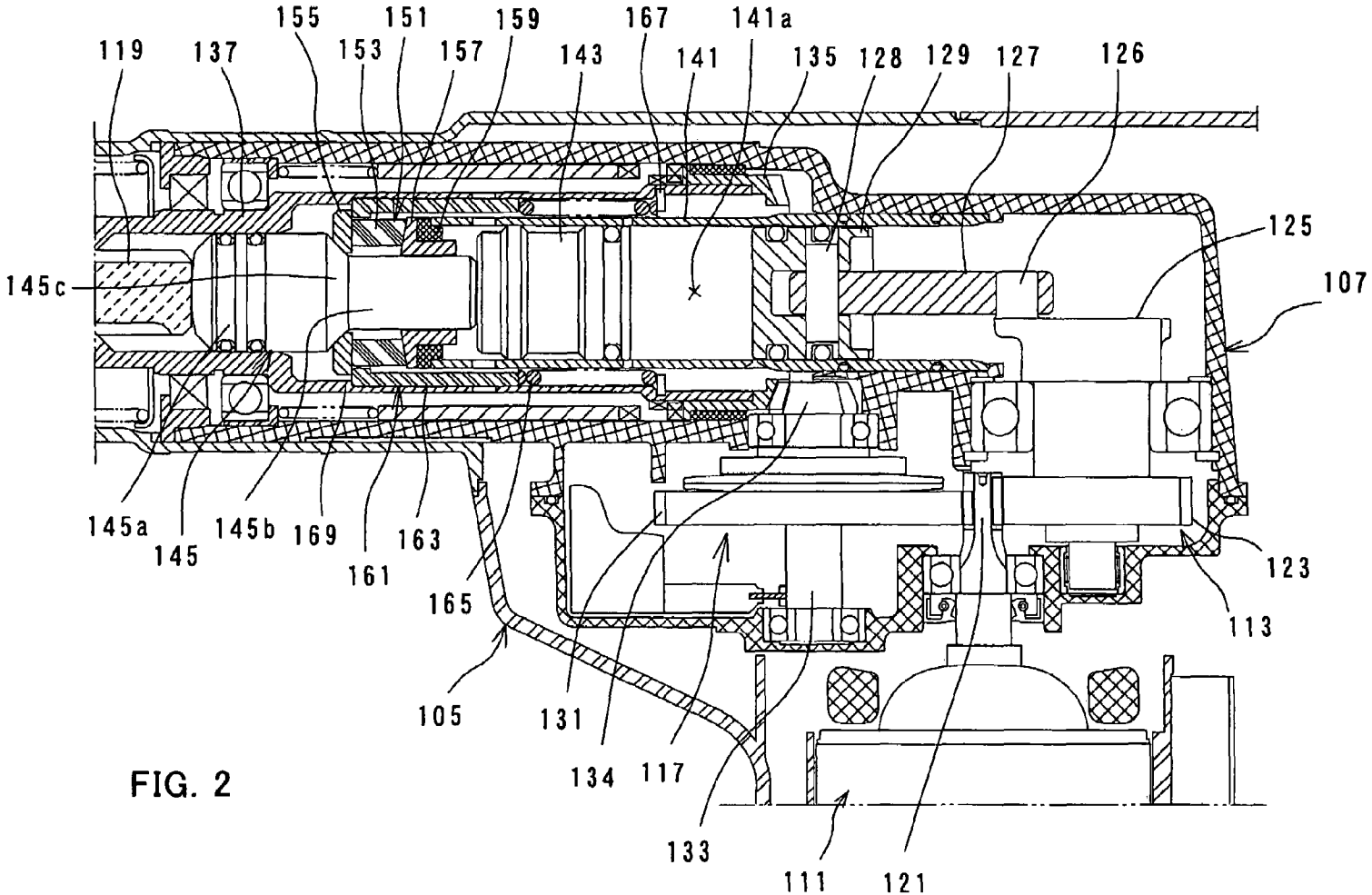
FIG. 2 is an enlarged sectional view showing an essential part of the hammer drill.

FIG. 2 is an enlarged sectional view showing an essential part of the hammer drill 101. The motion converting mechanism 113 includes a driving gear 121 that is rotated in a horizontal plane by the driving motor 111, a driven gear 123 that engages with the driving gear 121, a crank plate 125 that rotates together with the driven gear 123 in a horizontal plane, a crank arm 127 that is loosely connected at one end to the crank plate 125 via an eccentric shaft 126 in a position displaced a predetermined distance from the center of rotation of the crank plate 125, and a driving element in the form of a piston 129 mounted to the other end of the crank arm 127 via a connecting shaft 128. The motion converting mechanism 113 is a feature that corresponds to the "driving mechanism" according to this invention. The crank plate 125, the crank arm 127 and the piston 129 form a crank mechanism.

The power transmitting mechanism 117 includes a driving gear 121 that is driven by the driving motor 111, a transmission gear 131 that engages with the driving gear 121, a transmission shaft 133 that is caused to rotate in a horizontal plane together with the transmission gear 131, a small bevel gear 134 mounted onto the transmission shaft 133, a large bevel gear 135 that engages with the small bevel gear 134, and a tool holder 137 that is caused to rotate together with the large bevel gear 135 in a vertical plane. The hammer drill 101 can be switched between hammering mode and hammer drill mode. In the hammering mode, the hammer drill 101 performs a hammering operation on a workpiece by applying only a striking force to the hammer bit 119 in its axial direction. In the hammer drill mode, the hammer drill 101 performs a hammer drill operation on a workpiece by applying a striking force in the axial direction and a rotating force in the circumferential direction to the hammer bit 119. This construction of the hammer drill 101 is not directly related to the present invention and therefore will not be described in further detail. The workpiece is not shown here in the drawings.

The striking mechanism 115 includes a striker 143 that is slidably disposed together with the piston 129 within the bore of the cylinder 141. The striker 143 is driven via the action of an air spring of an air chamber 141*a* of the cylinder 141 which is caused by sliding movement of the piston 129. The striker 143 then collides with (strikes) an intermediate element in the form of an impact bolt 145 that is slidably disposed within the tool holder 137 and transmits the striking force to the hammer bit 119 via the impact bolt 145. The impact bolt 145 and the hammer bit 119 are features that correspond to the "hammer actuating member" according to this invention. The impact bolt 145 includes a large-diameter portion 145*a*, a small-diameter portion 145*b* and a tapered portion 145*c*. The large-diameter portion 145*a* is fitted in close contact with the inner surface of the tool holder 137, while a predetermined extent of space is defined between a small-diameter portion 145*b* and the inner peripheral surface of the tool holder 137. The tapered portion 145*c* is formed in the boundary region between the both diameter portions 145*a* and 145*b*. The impact bolt 145 is disposed within the tool holder 137 in such an orientation that the large-diameter portion 145*a* is on the front side and the small-diameter portion 145*b* is on the rear side.

The hammer drill 101 includes a positioning member 151 that positions the body 103 with respect to the workpiece by contact with the impact bolt 145 when the impact bolt 145 is pushed rearward (toward the piston 129) together with the hammer bit 119 under loaded conditions in which the hammer bit 119 is pressed against the workpiece by the user's pressing force applied forward to the body 103. The positioning member 151 is a unit part including a rubber ring 153, a front-side hard metal washer 155 joined to the axially front surface of the rubber ring 153, and a rear-side hard metal washer 157 joined to the axially rear surface of the rubber ring 153. The positioning member 151 is loosely fitted onto the small-diameter portion 145*b* of the impact bolt 145.

When the impact bolt 145 is pushed rearward, the tapered portion 145*c* of the impact bolt 145 contacts the front metal washer 155 of the positioning member 151 and the rear metal washer 157 contacts the front end of the cylinder 141. Thus, the rubber ring 153 of the positioning member 151 elastically connects the impact bolt 145 to the cylinder 141 that is fixedly mounted to the gear housing 107. The rubber ring 153 is a feature that corresponds to the "elastic member" according to this invention. The front metal washer 155 has a tapered bore. When the impact bolt 145 is pushed rearward, the tapered surface of the front metal washer 155 closely contacts the tapered portion 145*c* of the impact bolt 145. Further, the rear metal washer 157 has a generally hat-like sectional shape, having a cylindrical portion of a predetermined length which is fitted onto the small-diameter portion 145*b* of the impact bolt 145 and a flange that extends radially outward from the cylindrical portion. The rear surface of the flange is in contact with the axial front end of the cylinder 141 via a spacer 159.

The hammer drill according to this embodiment includes an impact damper 161 for cushioning the impact force (reaction force) that is caused by rebound of the hammer bit 119 after the striking movement of the hammer bit 119 during hammering operation on the workpiece. The impact damper 161 includes a hard metal cylindrical weight 163 that contacts the impact bolt 145 via the front metal washer 155 and a coil spring 165 that normally biases the cylindrical weight 163 toward the impact bolt 145 (forward). The cylindrical weight 163, the coil spring 165 and the front metal washer 155 are features that correspond to the "weight", the "elastic element" and the "intervening member", respectively, according to this invention.

The cylindrical weight 163 is disposed between the outer surface of the positioning member 151 and an inner surface of the tool holder 137 and can move in the axial direction of the hammer bit. The movement of the weight 163 is guided along the inner surface of the tool holder 137. Specifically, the cylindrical weight 163 and the positioning member 151 are arranged in parallel in the radial direction and in the same position on the axis of the hammer bit 119. The cylindrical weight 163 extends further rearward from the outer peripheral region of the positioning member 151 to the outer front region of the cylinder 141. The coil spring 165 is disposed between the rear end of the weight 163 and the tool holder 137. The coil spring 165 is elastically disposed between the weight 163 and the tool holder 137 under a predetermined initial load. Thus, the cylindrical weight 163 is biased forward and its front end is normally in contact with a stepped position control stopper 169 formed in the tool holder 137, so that the weight 163 is prevented from moving forward beyond its striking position. In other words, the biasing force (elastic force) of the coil spring 165 that biases the weight 163 forward is controlled to be prevented from substantially acting forward beyond the striking position of the weight 163. The striking position here refers to a position in which the striker 143 collides with (strikes) the impact bolt 145. This striking position coincides with a position in which the reaction force from the impact bolt 145 is transmitted to the weight 163. This striking position is a feature that corresponds to the "reaction force transmitting position" according to this invention. Further, the position control stopper 169 is a feature that corresponds to the "control member" according to this invention.

Under loaded conditions in which the impact bolt 145 is pushed rearward together with the hammer bit 119, the axial front end of the cylindrical weight 163 is in surface contact with the radially outward portion of the rear surface of the front metal washer 155 of the positioning member 151. Specifically, the cylindrical weight 163 is in contact with the impact bolt 145 via the front metal washer 155. Therefore, when the hammer bit 119 and the impact bolt 145 are caused to rebound by receiving a reaction force from the workpiece after striking movement, the reaction force from the impact bolt 145 is transmitted to the cylindrical weight 163 which is in contact with the impact bolt 145 via the front metal washer 155. The front metal washer 155 forms a reaction force transmitting member and has a larger diameter than the outside diameter of the rubber ring 153. Thus, the axial front end of the cylindrical weight 163 is in contact with an outer region of the front metal washer 155 outward of the outer surface of the rubber ring 153 of the front metal washer 155. When the cylindrical weight 163 is moved rearward by receiving a reaction force from the impact bolt 145, the coil spring 165 is pushed by the cylindrical weight 163. As a result, the coil spring 165 elastically deforms and absorbs the reaction force. One axial end of the coil spring 165 is held in contact with the axial rear end surface of the cylindrical weight 163 and the other axial end is in contact with a spring receiving ring 167 fixed to the tool holder 137.

Figure 3:
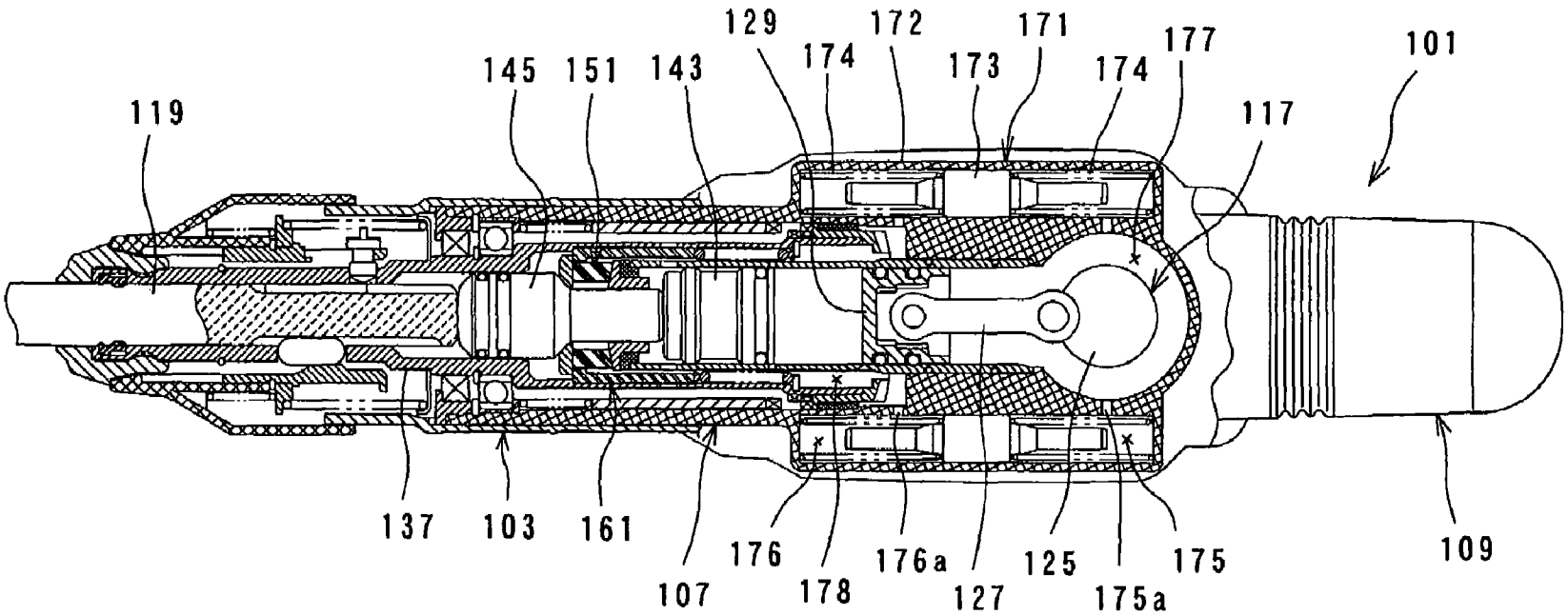
FIG. 3 is a sectional plan view showing the hammer drill having a dynamic vibration reducer.
Figure 4:
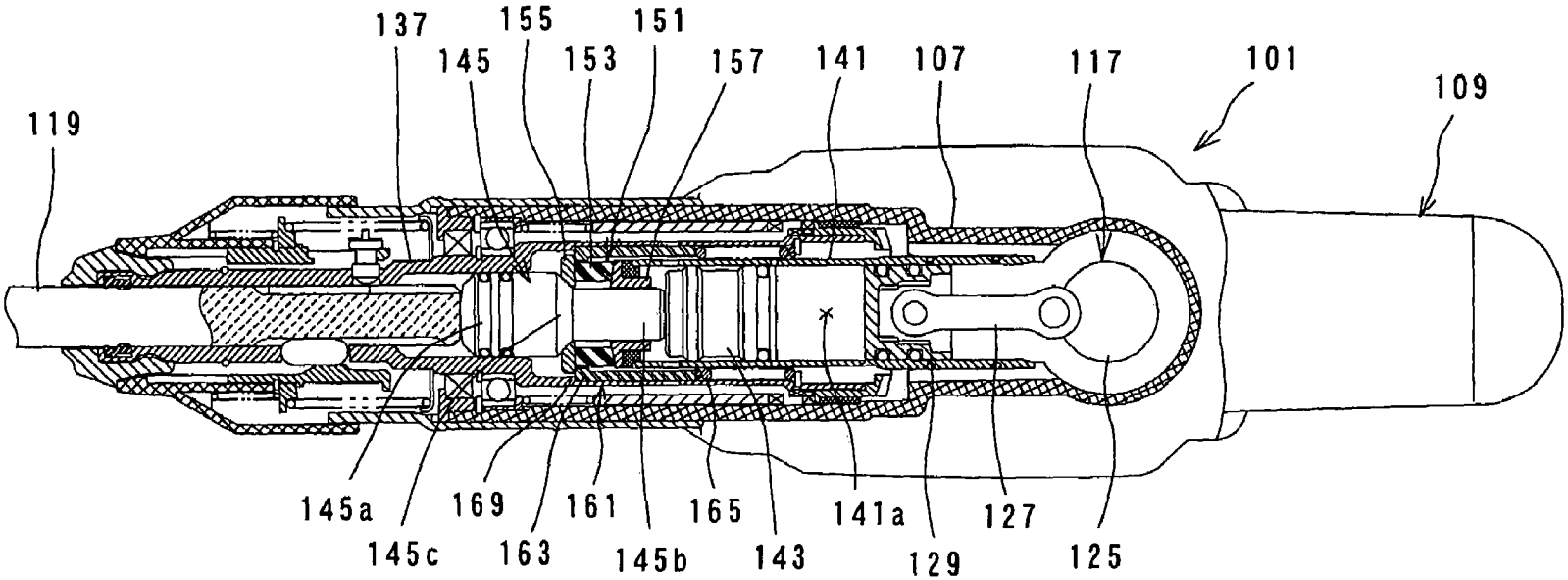
FIG. 4 is a sectional plan view showing the hammer drill under loaded conditions in which the hammer bit is pressed against the workpiece.

Further, according to this embodiment, as shown in FIG. 3 showing the hammer drill 101 in sectional plan view, the hammer drill 101 includes a pair of dynamic vibration reducers 171. The dynamic vibration reducers 171 are arranged on the both sides of the axis of the hammer bit 119 and have the same construction. Each of the dynamic vibration reducers 171 mainly includes a cylindrical body 172 that is disposed adjacent to the body 103, a weight 173 that is disposed within the cylindrical body 172, and biasing springs 174 that are disposed on the right and left sides of the weight 173. The weight 173 is a feature that corresponds to the "vibration reducing weight" according to this invention. The biasing springs 174 exert a spring force on the weight 173 in a direction toward each other when the weight 173 moves in the axial direction of the cylindrical body 172 (in the axial direction of the hammer bit 119). The dynamic vibration reducer 171 having the above-described construction serves to reduce impulsive and cyclic vibration caused when the hammer bit 119 is driven. Specifically, the weight 173 and the biasing springs 174 serve as vibration reducing elements in the dynamic vibration reducer 171 and cooperate to passively reduce vibration of the body 103 of the hammer drill 101 on which a predetermined outside force (vibration) is exerted. Thus, the vibration of the hammer drill 101 of this embodiment can be effectively alleviated or reduced.

Further, in the dynamic vibration reducer 171 of this embodiment, a first actuation chamber 175 and a second actuation chamber 176 are defined on the both sides of the weight 173 within the cylindrical body 172. The first actuation chamber 175 communicates with the crank chamber 177 via a first communicating portion 175*a*. The crank chamber 177 is normally hermetic and prevented from communication with the outside. The second actuation chamber 176 communicates with a cylinder accommodating space 178 of the gear housing 107 via a second communicating portion 176*a* and substantially with the atmosphere. The pressure within the crank chamber 177 fluctuates when the motion converting mechanism 113 is driven. Such pressure fluctuations are caused when the piston 129 forming the motion converting mechanism 113 linearly moves within the cylinder 141. The fluctuating pressure caused within the crank chamber 177 is introduced from the first communicating portion 175*a* to the first actuation chamber 175, and the weight 173 of the dynamic vibration reducer 171 is actively driven. In this manner, the dynamic vibration reducer 171 performs a vibration reducing function. Specifically, the dynamic vibration reducer 171 serves as an active vibration reducing mechanism for reducing vibration by forced vibration in which the weight 173 is actively driven. Thus, the vibration which is caused in the body 103 during hammering operation can be further effectively reduced or alleviated.

Operation of the hammer drill 101 constructed as described above is now explained. When the driving motor 111 (shown in FIG. 1) is driven, the rotating output of the driving motor 111 causes the driving gear 121 to rotate in the horizontal plane. When the driving gear 121 rotate, the crank plate 125 revolves in the horizontal plane via the driven gear 123 that engages with the driving gear 121. Then, the piston 129 slidingly reciprocates within the cylinder 141 via the crank arm 127. The striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on a workpiece.

When the hammer drill 101 is driven in hammer drill mode, the driving gear 121 is caused to rotate by the rotating output of the driving motor 111, and the transmission gear 131 that engages with the driving gear 121 is caused to rotate together with the transmission shaft 133 and the small bevel gear 134 in a horizontal plane. The large bevel gear 135 that engages with the small bevel gear 134 is then caused to rotate in a vertical plane, which in turn causes the tool holder 137 and the hammer bit 119 held by the tool holder 137 to rotate together with the large bevel gear 135. Thus, in the hammer drill mode, the hammer bit 119 performs a striking movement in the axial direction and a rotary movement in the circumferential direction, so that the hammer drill operation is performed on the workpiece.

The above-described operation is performed in the state in which the hammer bit 119 is pressed against the workpiece and in which the hammer bit 119 and the tool holder 137 are pushed rearward as shown in FIGS. 1 to 4. The impact bolt 145 is pushed rearward when the tool holder 137 is pushed rearward. The impact bolt 145 then contacts the front metal washer 155 of the positioning member 151 and the rear metal washer 157 contacts the front end of the cylinder 141. Specifically, the cylinder 141 on the body 103 side receives the force of pushing in the hammer bit 119, so that the body 103 is positioned with respect to the workpiece. In this state, a hammering operation or a hammer drill operation is performed. At this time, as described above, the front end surface of the cylindrical weight 163 of the impact damper 161 is held in contact with the rear surface of the front metal washer 155 of the positioning member 151.

Figure 5:
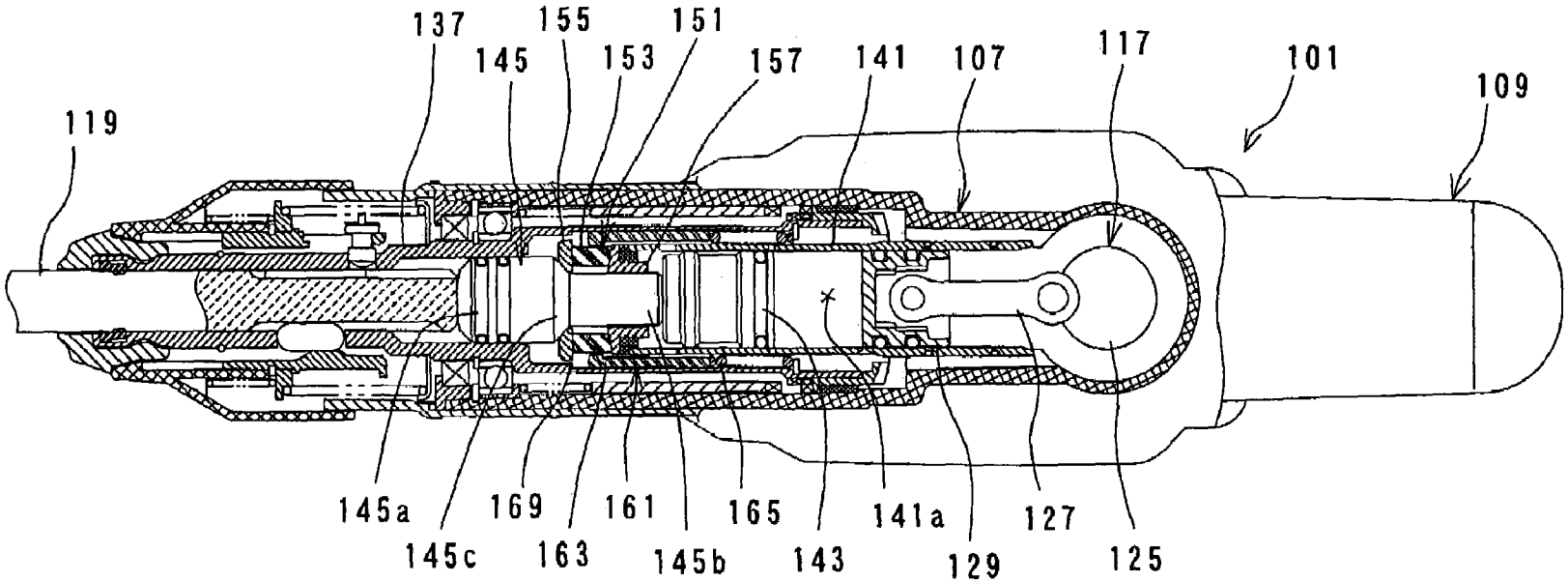
FIG. 5 is a sectional plan view showing the hammer drill during operation of an impact damper.

After striking movement of the hammer bit 119 upon the workpiece, the hammer bit 119 is caused to rebound by the reaction force from the workpiece. This rebound causes the impact bolt 145 to be acted upon by a rearward reaction force. At this time, the cylindrical weight 163 of the impact damper 161 is in contact with the impact bolt 145 via the front metal washer 155 of the positioning member 151. Therefore, in this state of contact via the front metal washer 155, the reaction force of the impact bolt 145 is transmitted to the cylindrical weight 163. In other words, momentum is exchanged between the impact bolt 145 and the cylindrical weight 163. By such transmission of the reaction force, the impact bolt 145 is held substantially at rest in the striking position, while the cylindrical weight 163 is caused to move rearward in the direction of action of the reaction force. As shown in FIG. 5, the rearward moving cylindrical weight 163 elastically deforms the coil spring 165, and the reaction force of the weight 163 is absorbed by such elastic deformation.

At this time, the reaction force of the impact bolt 145 also acts upon the rubber ring 153 kept in contact with the impact bolt 145 via the front metal washer 155. Generally, the transmission rate of a force of one object is raised according to the Young's modulus of the other object placed in contact with the one object. According to this embodiment, the cylindrical weight 163 of the impact damper 161 is made of hard metal and has high Young's modulus, while the rubber ring 153 made of rubber has low Young's modulus. Therefore, most of the reaction force of the impact bolt 145 is transmitted to the cylindrical weight 163 which has high Young's modulus and which is placed in contact with the metal impact bolt 145 via the hard front metal washer 155. Thus, the impact force caused by rebound of the hammer bit 119 and the impact bolt 145 can be efficiently absorbed by the rearward movement of the cylindrical weight 163 and by the elastic deformation of the coil spring 165 which is caused by the movement of the cylindrical weight 163. As a result, vibration of the hammer drill 101 can be reduced.

Thus, according to this embodiment, most of the reaction force that the hammer bit 119 and the impact bolt 145 receive from the workpiece after the striking movement is transmitted from the impact bolt 145 to the cylindrical weight 163. The impact bolt 145 is placed substantially at rest as viewed from the striking position. Therefore, only a small reaction force acts upon the rubber ring 153. Accordingly, only a slight amount of elastic deformation is caused in the rubber ring 153 by such reaction force, and a subsequent repulsion is also reduced. Further, the reaction force of the impact bolt 145 can be absorbed by the impact damper 161 which includes the cylindrical weight 163 and the coil spring 165. Therefore, the rubber ring 153 can be made hard. As a result, such rubber ring 153 can provide correct positioning of the body 103 with respect to the workpiece.

Further, according to this embodiment, the stopper 169 controls the biasing force of the coil spring 165 such that the biasing force is prevented from substantially acting forward beyond the striking position. Therefore, during striking movement, when the user applies a pressing force forward to the body 103 to hold the hammer bit 119 and the impact bolt 145 in the striking position, even with a provision of the coil spring 165 for absorbing the reaction force, unnecessary force for holding the hammer bit 119 and the impact bolt 145 is not required. Unlike the construction, such as an idle driving prevention mechanism, in which a forward spring force normally acts upon the hammer bit 119 and the impact bolt 145 during striking movement, an efficient mechanism of which elastic force for absorbing a reaction force has no adverse effect can be realized.

Further, according to this embodiment, the forward position of the cylindrical weight 163 is mechanically controlled by the stopper 169. Thus, in this state in which the biasing force of the coil spring 165 is applied to the cylindrical weight 163, the cylindrical weight 163 is controlled to be prevented from moving beyond the striking position. Therefore, the condition settings for absorption of the reaction force, including the settings of the biasing force of the coil spring 165 or the weight of the cylindrical weight 163, can be facilitated.

Further, according to this embodiment, the reaction force from the workpiece is transmitted to the cylindrical weight 163 via the hammer bit 119 and the impact bolt 145. Thus, the reaction force from the workpiece can be transmitted in a concentrated manner to the cylindrical weight 163 without being scattered midway on the transmission path. As a result, the efficiency of transmission of the reaction force to the cylindrical weight 163 is increased, so that the impact absorbing function can be enhanced.

Further, the cylindrical weight 163 and the positioning member 151 are arranged in parallel in the radial direction and in the same position on the axis of the hammer bit 119. Thus, an effective configuration for space savings can be realized. Further, the impact bolt 145 contacts the cylindrical weight 163 and the rubber ring 153 via a common hard metal sheet or the front metal washer 155. Therefore, the reaction force of the impact bolt 145 can be transmitted from one point to two members via a common member, that is, from the impact bolt 145 to the cylindrical weight 163 and the rubber ring 153 via the front metal washer 155. Further, the structure can be simplified.

Second Representative Embodiment

Figure 6:
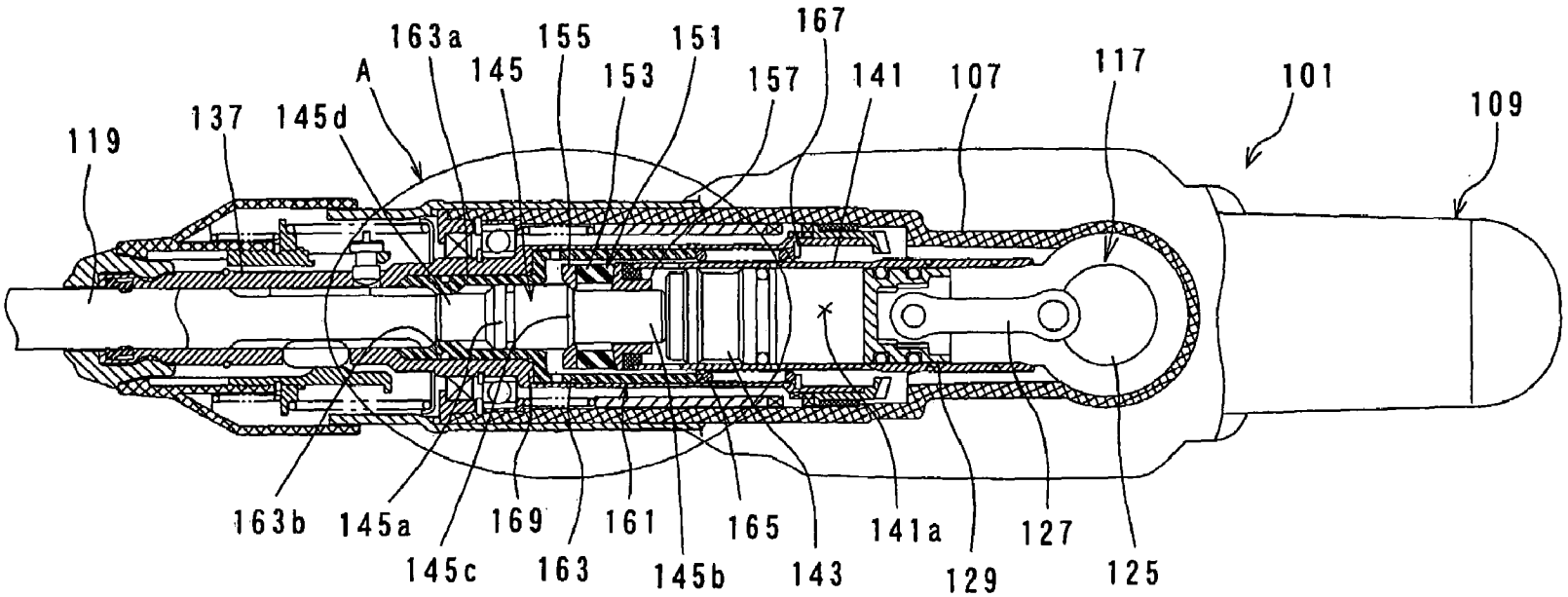
FIG. 6 is a sectional plan view showing an electric hammer drill according to a second embodiment of this invention, under loaded conditions in which the hammer bit is pressed against the workpiece.
Figure 7:
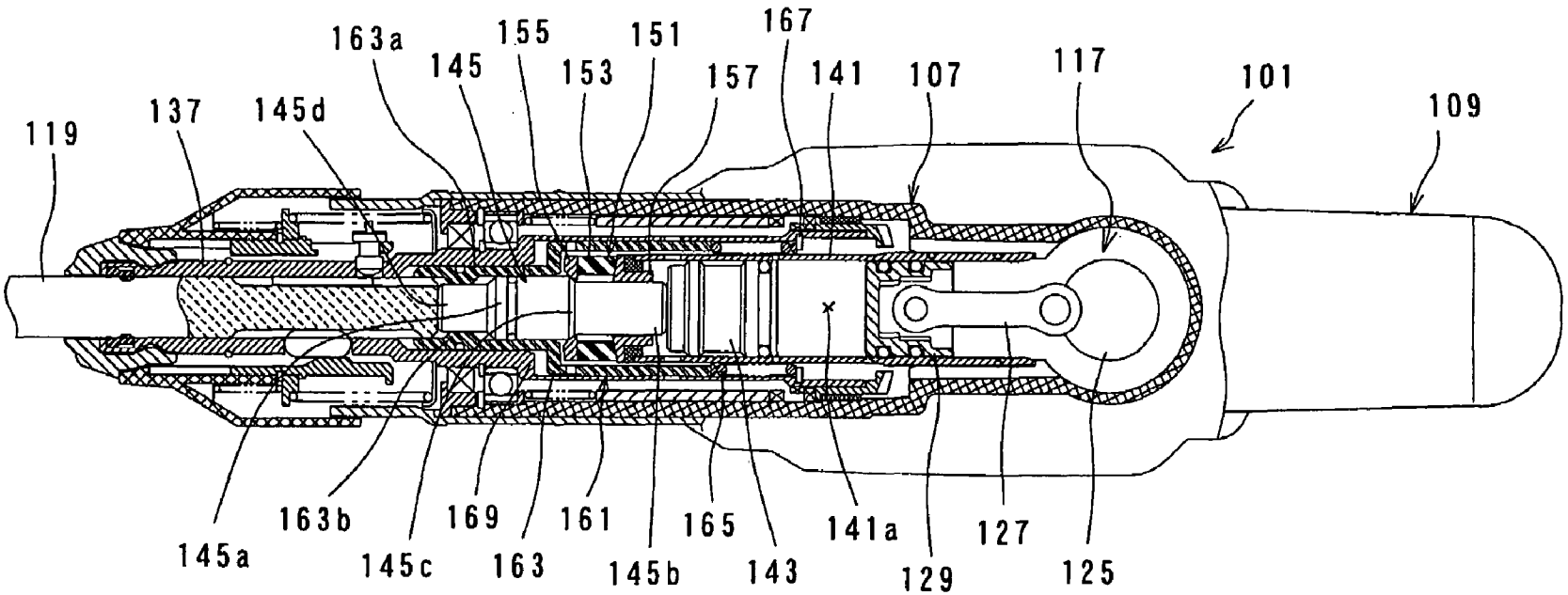
FIG. 7 is a sectional plan view showing the hammer drill of the second embodiment, during operation of the impact damper.
Figure 8:
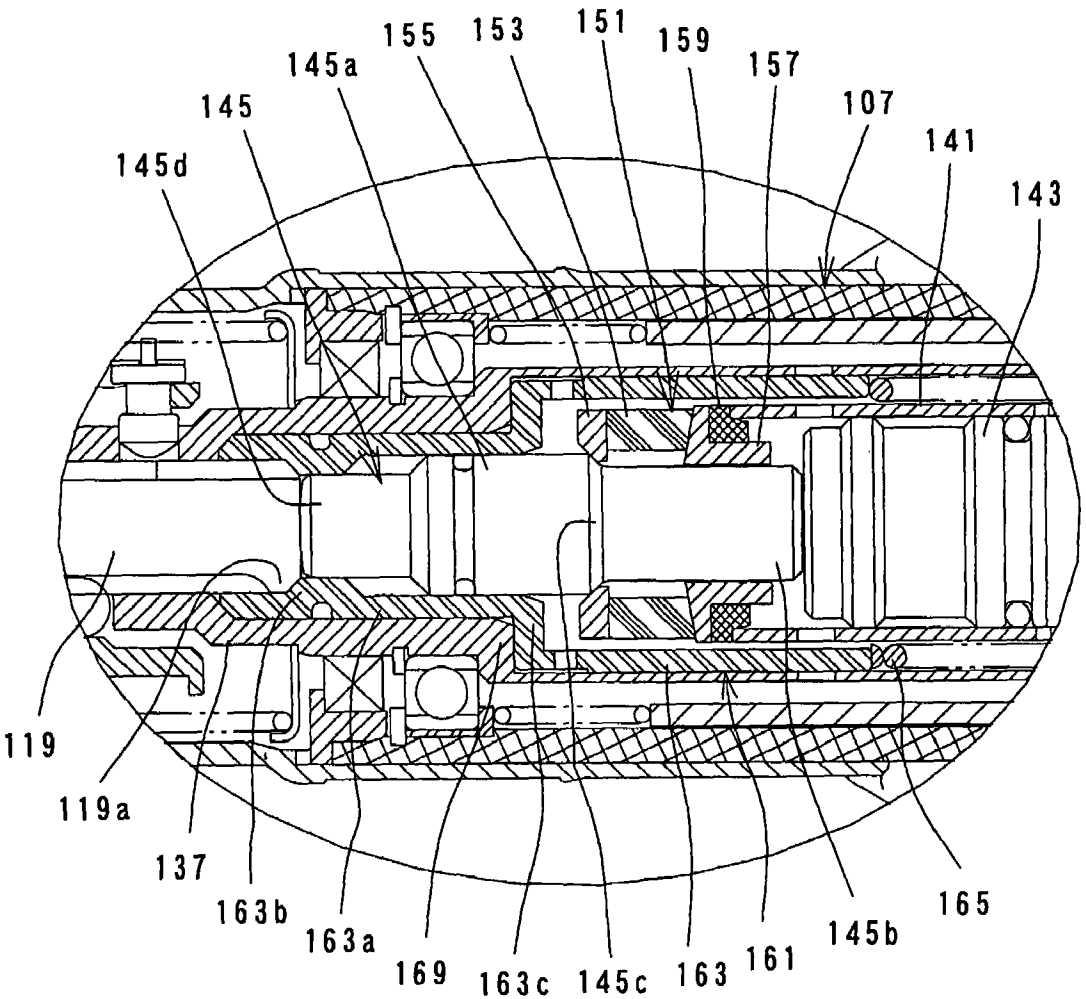
FIG. 8 is an enlarged view of part A in FIG. 6.
Figure 9:
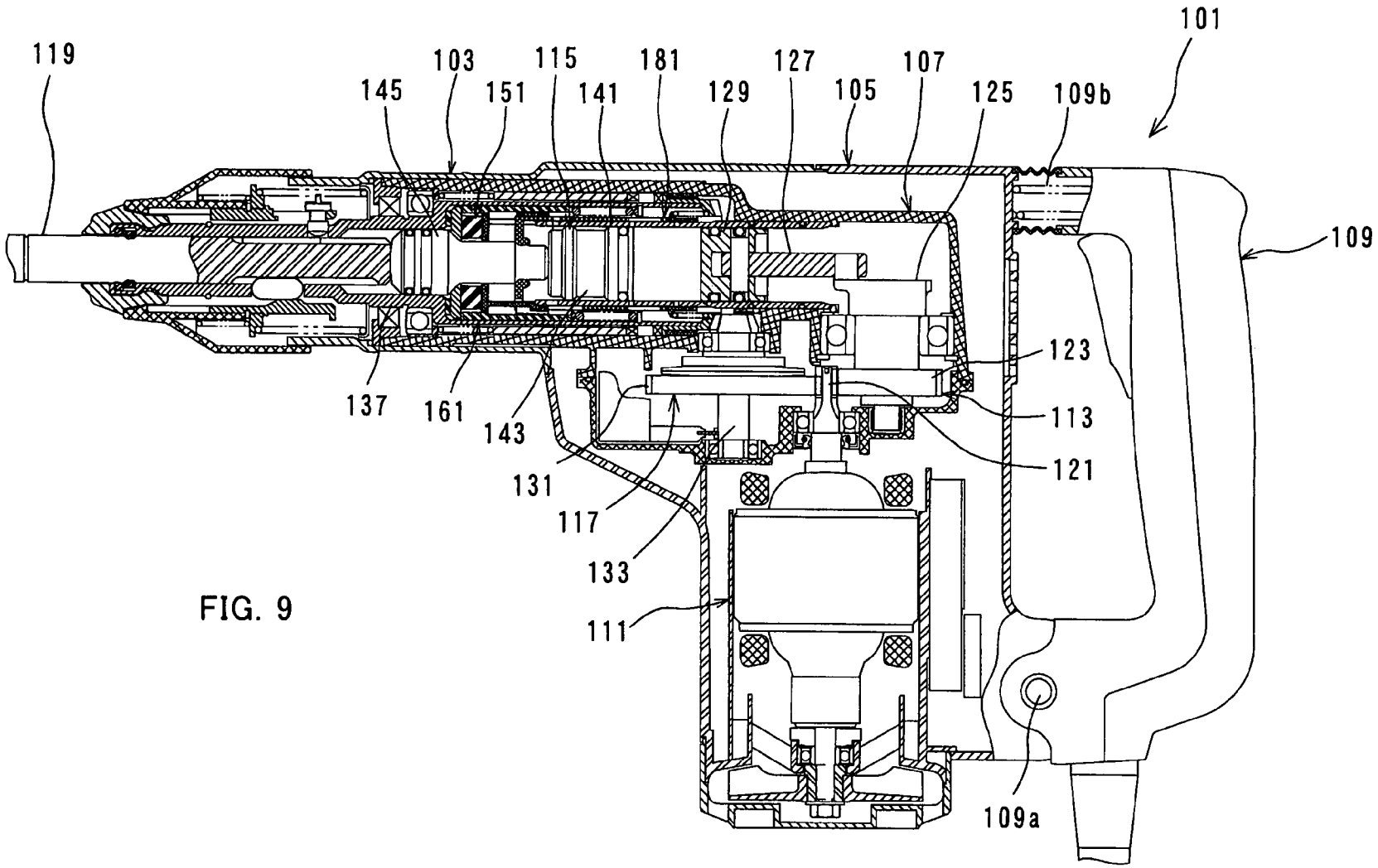
FIG. 9 is a sectional side view schematically showing an entire electric hammer drill according to a third embodiment of this invention, under loaded conditions in which a hammer bit is pressed against a workpiece.
Figure 10:
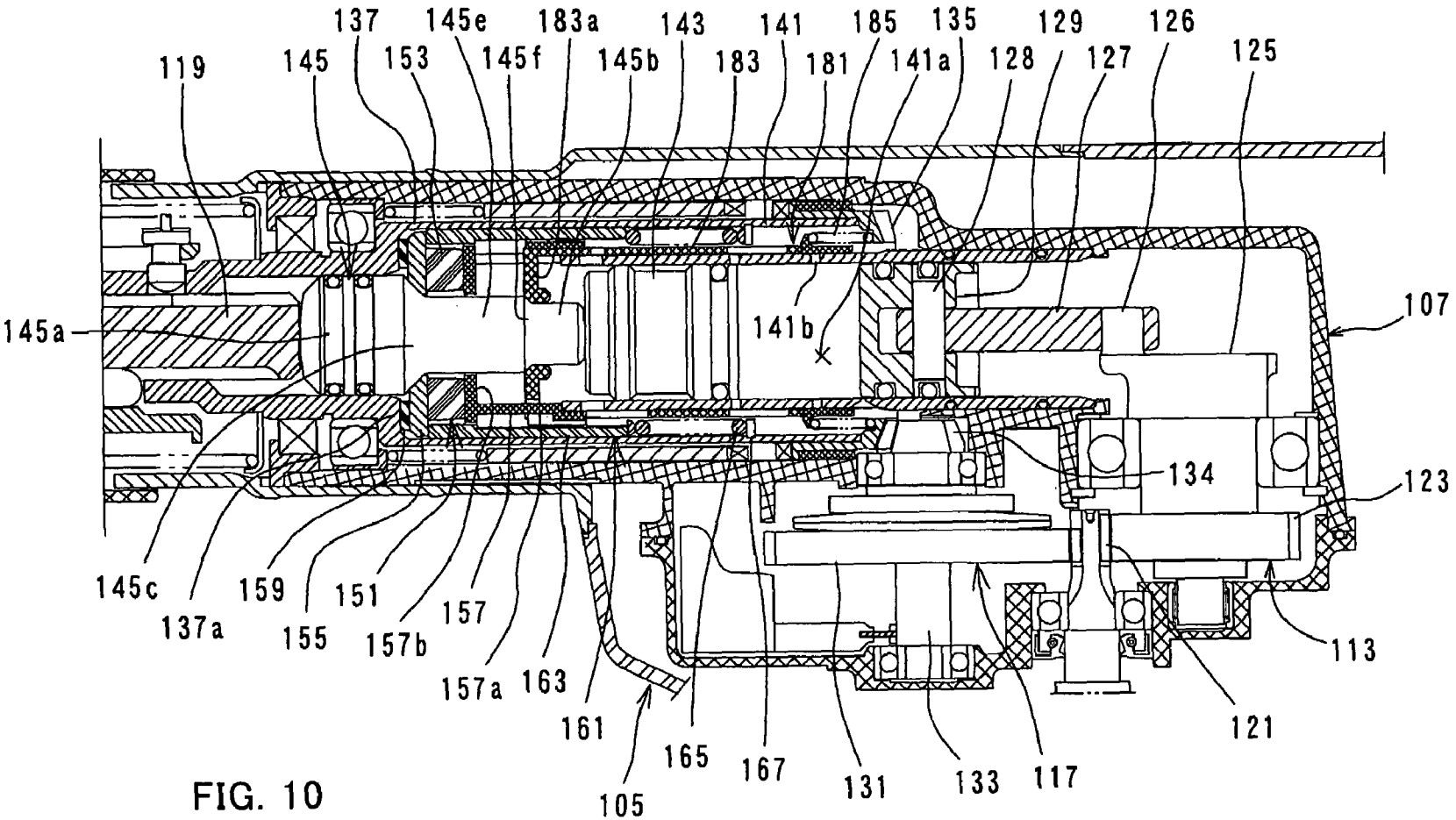
FIG. 10 is an enlarged sectional view showing an essential part of the hammer drill.

Now, a second representative embodiment of the present invention is described with reference to FIGS. 6 to 8. In the second embodiment, the reaction force (rebound) caused during the striking movement is transmitted from the hammer bit 119 to the impact damper 161 and except for this point, the second representative embodiment has the same construction as the first embodiment. Thus, components and elements in the second embodiment which are substantially identical to those in the first embodiment are given like numerals as in the first embodiment and is not described or only briefly described.

In this embodiment, the impact bolt 145 has a large-diameter portion 145*a* in the middle in its axial direction and small-diameter portions 145*b*, 145*d* on the rear and front sides of the large-diameter portion 145*a*. Further, a tapered portion 145*c* is formed in the boundary region between the rear small-diameter portion 145*b* and the large-diameter portion 145*a*. The tapered surface of the front metal washer 155 of the positioning member 151 is held in contact with the tapered portion 145*c*. The front small-diameter portion 145*d* of the impact bolt 145 has an outside diameter smaller than the outside diameter of the hammer bit 119. Further, a predetermined extent of space is defined between the outer peripheral surface of the impact bolt 145 and the inner peripheral surface of the tool holder 137.

The cylindrical weight 163 made of hard metal and forming the impact damper 161 is disposed between the outer peripheral surface of the positioning member 151 and the outer peripheral front region of the cylinder 141 and the inner peripheral surface of the tool holder 137. The cylindrical weight 163 can move in the axial direction of the hammer bit in sliding contact with the inner peripheral surface of the tool holder 137. The cylindrical weight 163 is a feature that corresponds to the "weight" according to this invention. Further, the axial front region of the cylindrical weight 163 has a smaller diameter than its axial rear region and defined a small-diameter extension 163*a*. The small-diameter extension 163*a* extends forward through the space between the outer peripheral surface of the impact bolt 145 and the inner peripheral surface of the tool holder 137. The large-diameter portion 145*a* of the impact bolt 145 is axially moveably fitted into the bore of the small-diameter extension 163*a*. Further, a flange-like contact portion 163*b* is formed in the front end region of the inner peripheral surface of the small-diameter extension 163*a* and protrudes radially inward toward the front small-diameter portion 145*d* of the impact bolt 145.

Under loaded conditions in which the hammer bit 119 is pushed rearward, the tapered front surface of the contact portion 163*b* is held in surface contact with a head edge (rear end) portion 119*a* of the hammer bit 119. Thus, when the hammer bit 119 is caused to rebound by receiving the reaction force from the workpiece after the striking movement of the hammer bit 119, the reaction force of the hammer bit 119 is transmitted to the cylindrical weight 163 that is in direct contact with the hammer bit 119.

The inner peripheral surface or the protruding end of the contact portion 163*b* is closely fitted onto the front small-diameter portion 145*d* of the impact bolt 145. Thus, the impact bolt 145 is supported at two points of the large-diameter portion 154*a* and the front small-diameter portion 145*d* by the cylindrical weight 163, so that its axial relative movement can be stabilized. Further, a clearance is provided between the front surface of the front metal washer 155 of the positioning member 151 and the rear surface of a stepped portion 163*c* of the small-diameter extension 163*a* of the cylindrical weight 163. The clearance is large enough to allow the cylindrical weight 163 to move rearward by the reaction force from the hammer bit 119.

Under loaded conditions in which the hammer bit 119 is pressed against the workpiece, the head of the hammer bit 119 contacts the contact portion 163*b* of the cylindrical weight 163 when the hammer bit 119 and the impact bolt 145 are pushed rearward. Further, the tapered portion 145*c* of the impact bolt 145 contacts the front metal washer 155 of the positioning member 151, and the rear metal washer 157 contacts the front end of the cylinder 141. Thus, the cylinder 141 on the body 103 side receives the force of pushing in the hammer bit 119. This state is shown in FIGS. 6 and 8.

In this state, the hammer bit 119 is caused to rebound by the reaction force from the workpiece after the striking movement of the hammer bit 119. The reaction force of the hammer bit 119 is transmitted to the cylindrical weight 163 which is in contact with the hammer bit 119. Thus, the cylindrical weight 163 is caused to move rearward in the direction of action of the reaction force and elastically deforms the coil spring 165. As a result, the impact force caused by rebound of the hammer bit 119 is absorbed by the impact damper 161, so that vibration of the hammer drill 101 can be reduced. This state is shown in FIG. 7.

According to this embodiment, with the construction in which the reaction force from the workpiece is transmitted from the hammer bit 119 to the cylindrical weight 163, a wide installation space for the cylindrical weight 163 can be easily ensured in a region reward of the hammer bit 119 which is disposed in the tip end region of the body 103. Therefore, the freedom of design of the weight or the axial length of the cylindrical weight 163 can be enhanced.

In the above-described embodiments, the hammer drill 101 is described as a representative example of the impact power tool according to the invention. However, the present invention can also be applied to a hammer. Although the reaction force has been described as being transmitted via a path from the impact bolt 145 to the cylindrical weight 163 in the above one embodiment and via a path from the hammer bit 119 to the cylindrical weight 163 in the other embodiment, it may be configured to provide the both transmission paths. Specifically, a plurality of cylindrical weights may be provided in the body 103 such that the reaction force from the impact bolt is transmitted to one of the cylindrical weights and the reaction force from the hammer bit is transmitted to another cylindrical weight. Further, the cylindrical weight 163 forming the impact damper 161 may have a shape other than a cylindrical shape. Further, as a vibration reducing mechanism for reducing vibration by reciprocating in the same direction as the hammer bit 119, a counter weight may be used in place of the dynamic vibration reducer 171.

Further, in the above embodiments, a crank mechanism is described as being used as the motion converting mechanism 113 for converting the rotating output of the driving motor 111 to linear motion in order to linearly drive the hammer bit 119. However, the motion converting mechanism is not limited to the crank mechanism, but, for example, a swash plate that axially swings may be utilized as the motion converting mechanism. Further, in the above embodiments, the stopper 169 serves to prevent forward movement of the cylindrical weight 163 so that the biasing force of the coil spring 165 is controlled to be prevented from substantially acting forward beyond the striking position. However, instead of provision of control by the stopper 169, it may be changed in construction such that, for example, the coil spring 165 is disposed in a free state in which an initial load is not applied.

Third Representative Embodiment

A third representative embodiment of the present invention is now described with reference to FIGS. 9 to 13. In the third embodiment, an idle driving prevention mechanism (shown in drawings with a reference number 181) is further adapted and except for this point, the third representative embodiment has the same construction as the first embodiment. Thus, components and elements in the second embodiment which are substantially identical to those in the first embodiment are given like numerals as in the first embodiment and is not described or only briefly described.

According to this embodiment, the hammer drill 101 includes an idle driving prevention mechanism 181 that serves to prevent striking movement of the hammer bit 119 when the driving motor 111 is driven under unloaded conditions in which the hammer bit 119 is not pushed rearward. The air chamber 141*a* that serves to drive the striker 143 via the action of an air spring is in communication with the outside via an air hole 141*b*. The idle driving prevention mechanism 181 is provided to control opening and closing of the air hole 141*b*. The idle driving prevention mechanism 181 includes an actuation sleeve 183 and a pressure spring 185. The actuation sleeve 183 is switched between an open position in which the air hole 141*b* is opened and a closed position in which the air hole 141*b* is closed. The pressure spring 185 biases the actuation sleeve 183 toward the open position such that the actuation sleeve 183 is placed in the open position to open the air hole 141*b*. The open position and the closed position are features that correspond to the "non-actuating position" and the "actuating position", respectively, according to this invention. Further, the actuation sleeve 183 and the pressure spring 185 are features that correspond to the "air spring actuation member" and the "biasing member", respectively, according to this invention.

The actuation sleeve 183 is disposed in the outer peripheral region of the cylinder 141 and can move in the axial direction of the hammer bit 119. The actuation sleeve 183 has an inside flange portion 183*a* extending radially inward from its front end. When the impact bolt 145 is pushed rearward together with the hammer bit 119, the inside flange portion 183*a* is pushed by the rear tapered portion 145*f* between the small-diameter portion 145*b* and the medium-diameter portion 145*e* of the impact bolt 145, so that the actuation sleeve 183 is moved rearward. The biasing spring 185 is disposed between the actuation sleeve 183 and the tool holder 137. The biasing spring 185 biases the actuation sleeve 183 forward and normally holds the actuation sleeve 183 in the open position to open the air hole 141*b*. The action of the air spring is disabled when the air hole 141*b* is open, while it is enabled when the air hole 141*b* is closed.

While the actuation sleeve 183 according to this embodiment is divided into two parts in the axial direction, it may be substantially formed into one piece since the two sleeve parts are configured to move together. Further, the actuation sleeve 183 has about the same diameter as the cylindrical portion of the rear washer 157 of the positioning member 151. Therefore, in this embodiment, in order to prevent the actuation sleeve 183 and the cylindrical portion of the rear washer 157 from interfering with each other, slits are formed in the front region of the actuation sleeve 183 and the cylindrical portion of the rear washer 157 alternately in the circumferential direction. Thus, the actuation sleeve 183 and the cylindrical portion of the rear washer 157 can be disposed on the same diameter while preventing interference with each other.

Figure 11:
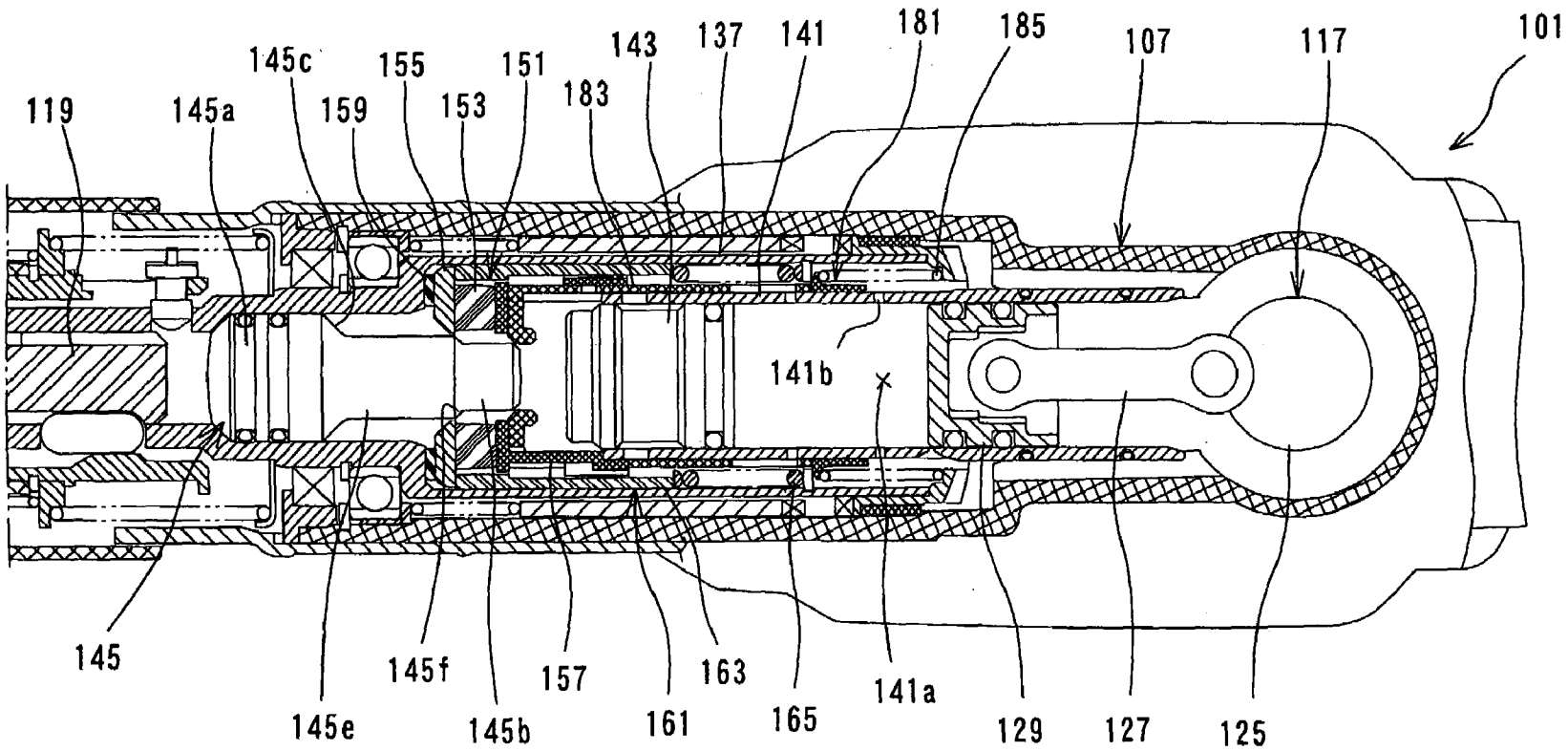
FIG. 11 is a sectional plan view showing the hammer drill under unloaded conditions in which the hammer bit is not pressed against the workpiece.

Operation of the hammer drill 101 constructed as described above is now explained. FIG. 11 shows the hammer drill 101 under unloaded conditions in which a pressing force is not applied to the body 103. Under the unloaded conditions, the actuation sleeve 183 is pushed forward and held in a position to open the air hole 141*b* by the action of the biasing spring 185 of the idle driving prevention mechanism 181. In this state, the air chamber 141*a* is in communication with the outside via the air hole 141*b*, which disables the action of the air spring. When the actuation sleeve 183 is pushed by the biasing spring 185, the front end inside flange portion 183*a* comes into contact with the rear surface of the inner flange 157*b* of the rear washer 157 of the positioning member 151. Thus, the actuation sleeve 183 is held in the open position.

Figure 12:
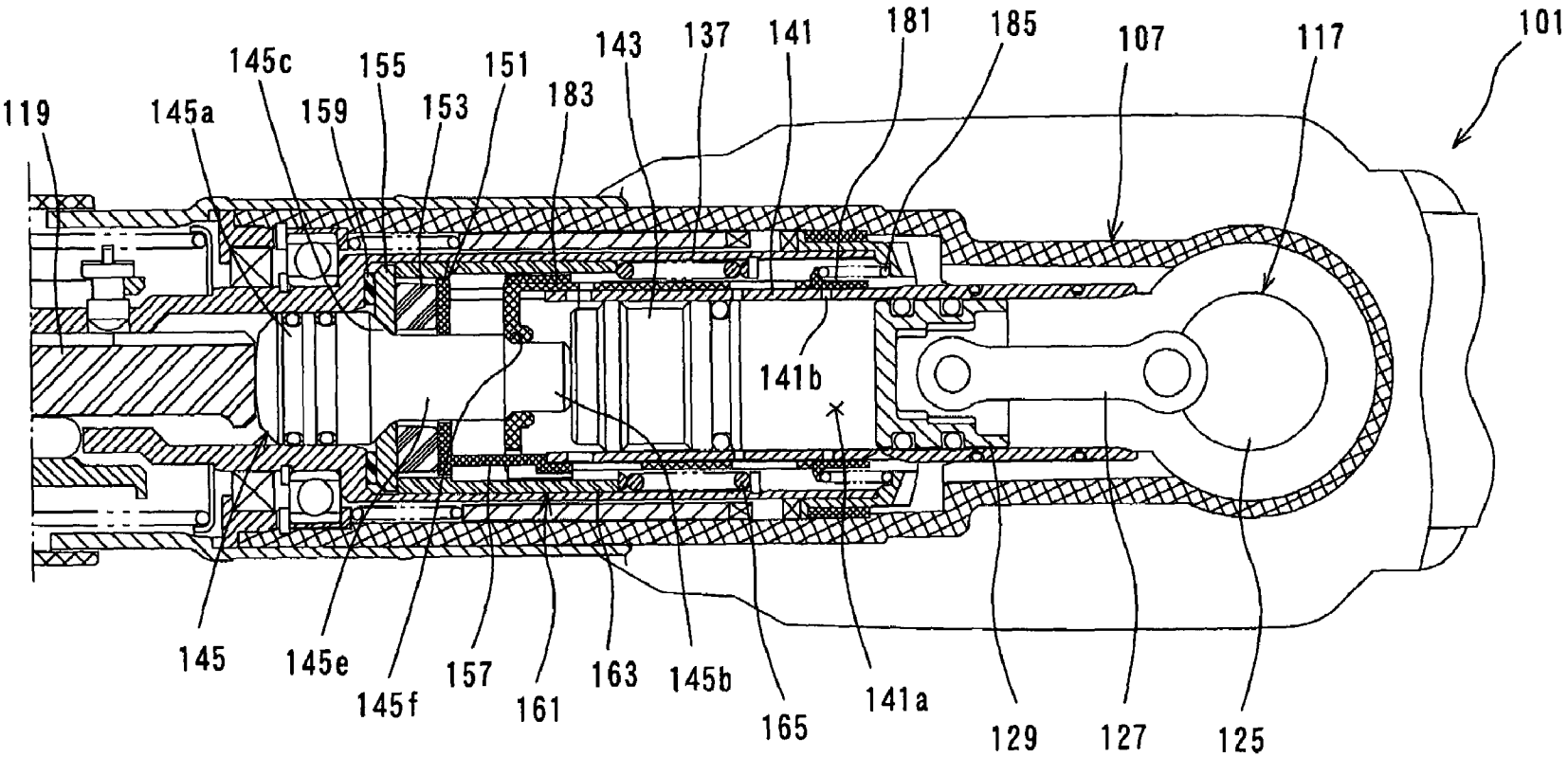
FIG. 12 is a sectional plan view showing the hammer drill under loaded conditions in which the hammer bit is pressed against the workpiece.

When the user applies a pressing force forward to the body 103 and the hammer bit 119 is pressed against the workpiece, the hammer bit 119 is pushed back by the workpiece and the impact bolt 145 is pushed rearward toward the piston 129 together with the hammer bit 119. Then, the rear tapered portion 145*f* of the impact bolt 145 contacts the inside flange portion 183*a* of the actuation sleeve 183 and the impact bolt 145 moves the actuation sleeve 183 rearward against the biasing force of the biasing spring 185. As a result, the actuation sleeve 183 closes the air hole 141*b* of the air chamber 141*a*, which enables the action of the air spring. Further, the impact bolt 145 contacts the front metal washer 155 of the positioning member 151 via the front tapered portion 145*c*. As a result, the cylinder 141 on the body 103 side receives the force of pushing in the hammer bit 119. Thus, the body 103 is positioned with respect to the workpiece. As described above, the front end surface of the cylindrical weight 163 of the impact damper 161 is held in contact with the rear surface of the front metal washer 155 of the positioning member 151. The hammer drill 101 under such loaded conditions is shown in FIG. 12.

When the driving motor 111 is driven, the driving gear 121 is caused to rotate in the horizontal plane by the rotating output of the driving motor 111. Then, the crank plate 125 revolves in the horizontal plane via the driven gear 123 that engages with the driving gear 121, which in turn causes the piston 129 to slidingly reciprocate within the cylinder 141 via the crank arm 127. At this time, under unloaded conditions in which the actuation sleeve 183 is held in a position to open the air hole 141*b*, air within the air chamber 141*a* is discharged to the outside, or air is taken in via the air hole 141*b*. Therefore, the action of a compression spring is not caused in the air chamber 141*a*. Therefore, idle driving of the hammer bit 119 is prevented. On the other hand, under loaded conditions in which the actuation sleeve 183 is held in a position to close the air hole 141*b*, the striker 143 reciprocates within the cylinder 141 and collides with (strikes) the impact bolt 145 by the action of the air spring function of the air chamber 141*a* as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on a workpiece.

When the hammer drill 101 is driven in hammer drill mode, the driving gear 121 is caused to rotate by the rotating output of the driving motor 111, and the transmission gear 131 that engages with the driving gear 121 is caused to rotate together with the transmission shaft 133 and the small bevel gear 134 in a horizontal plane. The large bevel gear 135 that engages with the small bevel gear 134 is then caused to rotate in a vertical plane, which in turn causes the tool holder 137 and the hammer bit 119 held by the tool holder 137 to rotate together with the large bevel gear 135. Thus, in the hammer drill mode, the hammer bit 119 performs a striking movement in the axial direction and a rotary movement in the circumferential direction, so that the hammer drill operation is performed on the workpiece.

Figure 13:
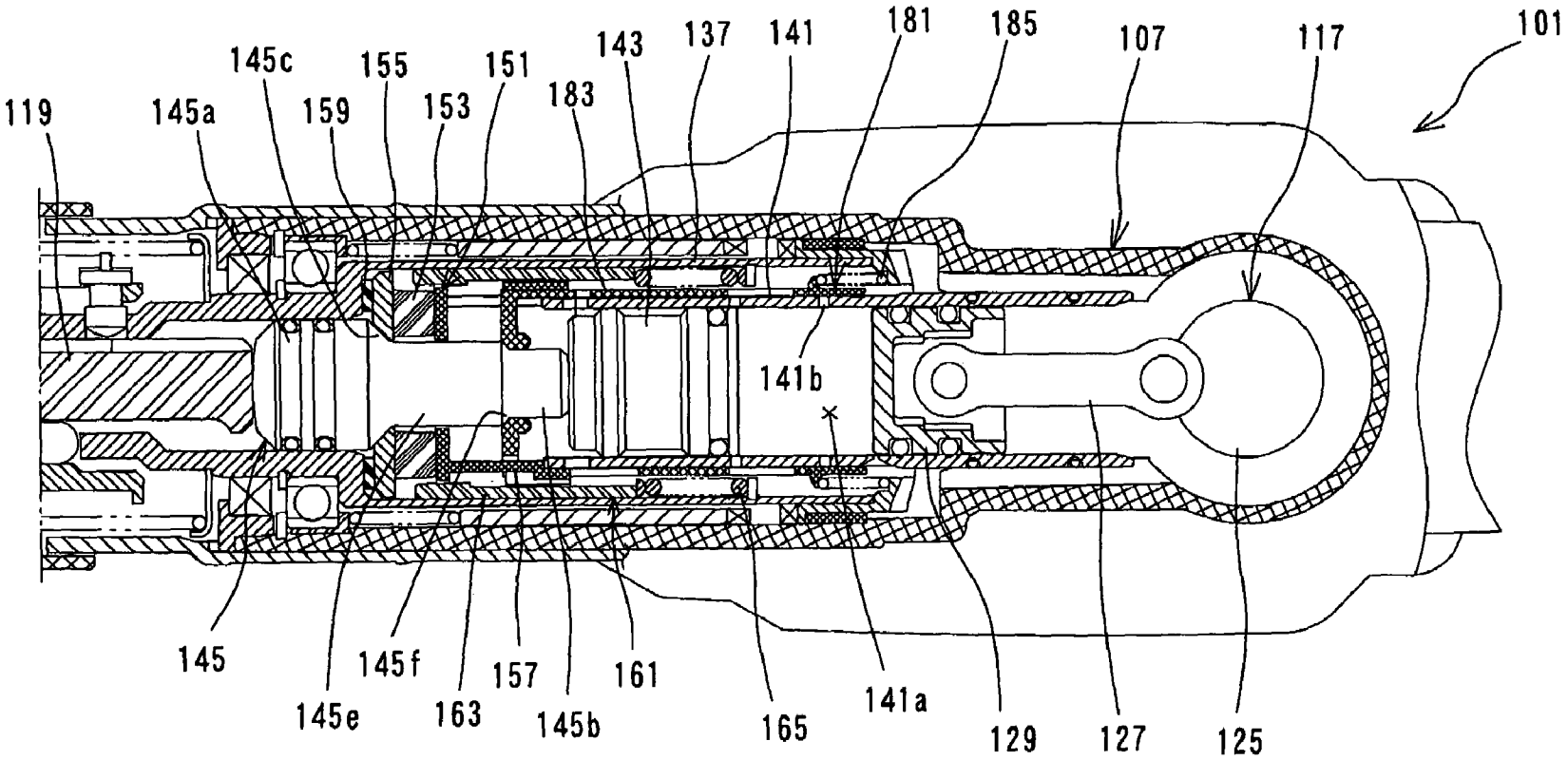
FIG. 13 is a sectional plan view showing the hammer drill during operation of an impact damper.

During the above-described hammering operation or hammer drill operation, after striking movement of the hammer bit 119 upon the workpiece, the hammer bit 119 is caused to rebound by the reaction force from the workpiece. This rebound causes the impact bolt 145 to be acted upon by a rearward reaction force. At this time, the cylindrical weight 163 of the impact damper 161 is in contact with the impact bolt 145 via the front metal washer 155 of the positioning member 151. As a result, the impact bolt 145 is held substantially at rest in the striking position, while the cylindrical weight 163 is caused to move rearward in the direction of action of the reaction force. As shown in FIG. 13, the rearward moving cylindrical weight 163 elastically deforms the coil spring 165, and the reaction force of the cylindrical weight 163 is absorbed by such elastic deformation.

Fourth Representative Embodiment

Figure 14:
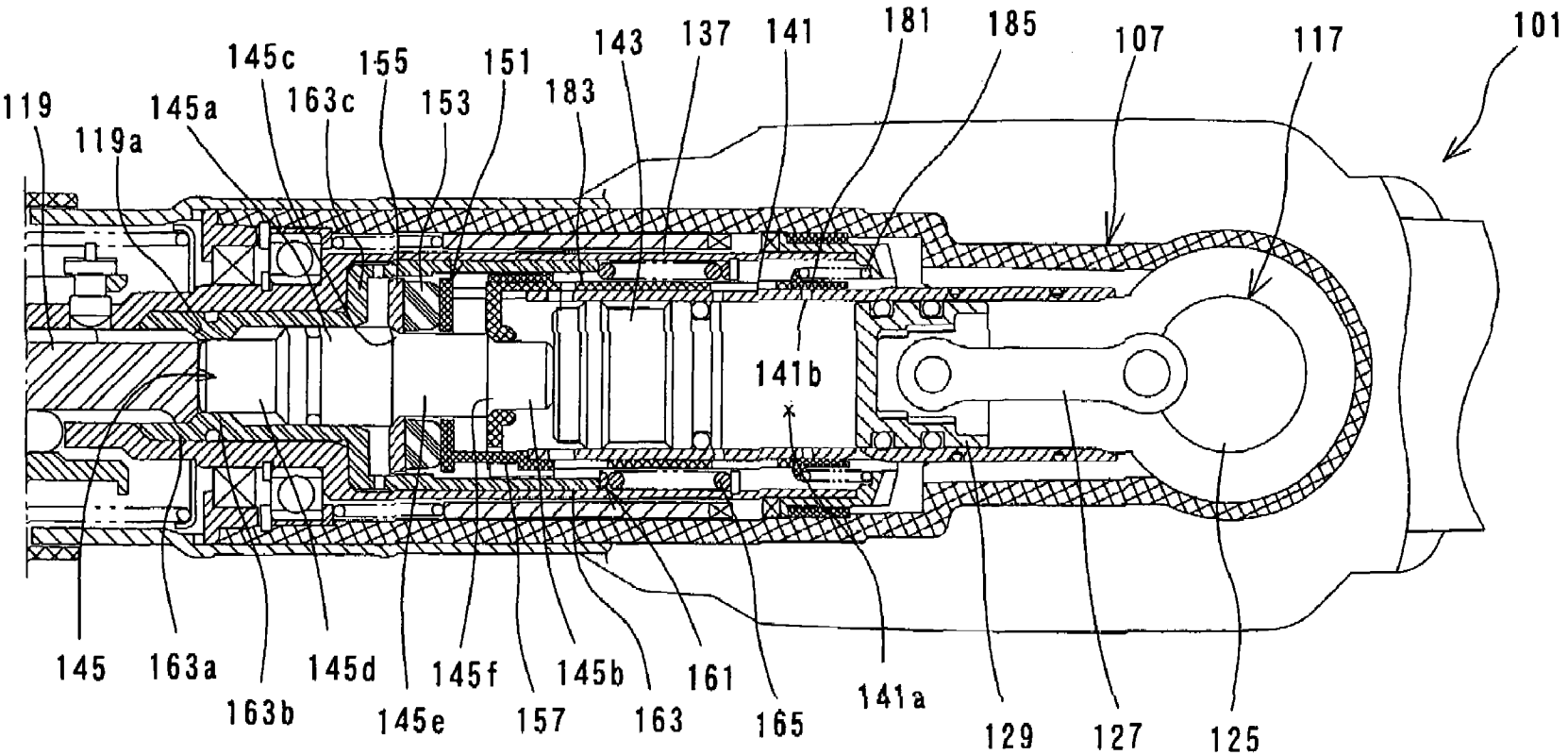
FIG. 14 is a sectional plan view showing an electric hammer drill according to a fourth embodiment of this invention, under loaded conditions in which the hammer bit is pressed against the workpiece.
Figure 15:
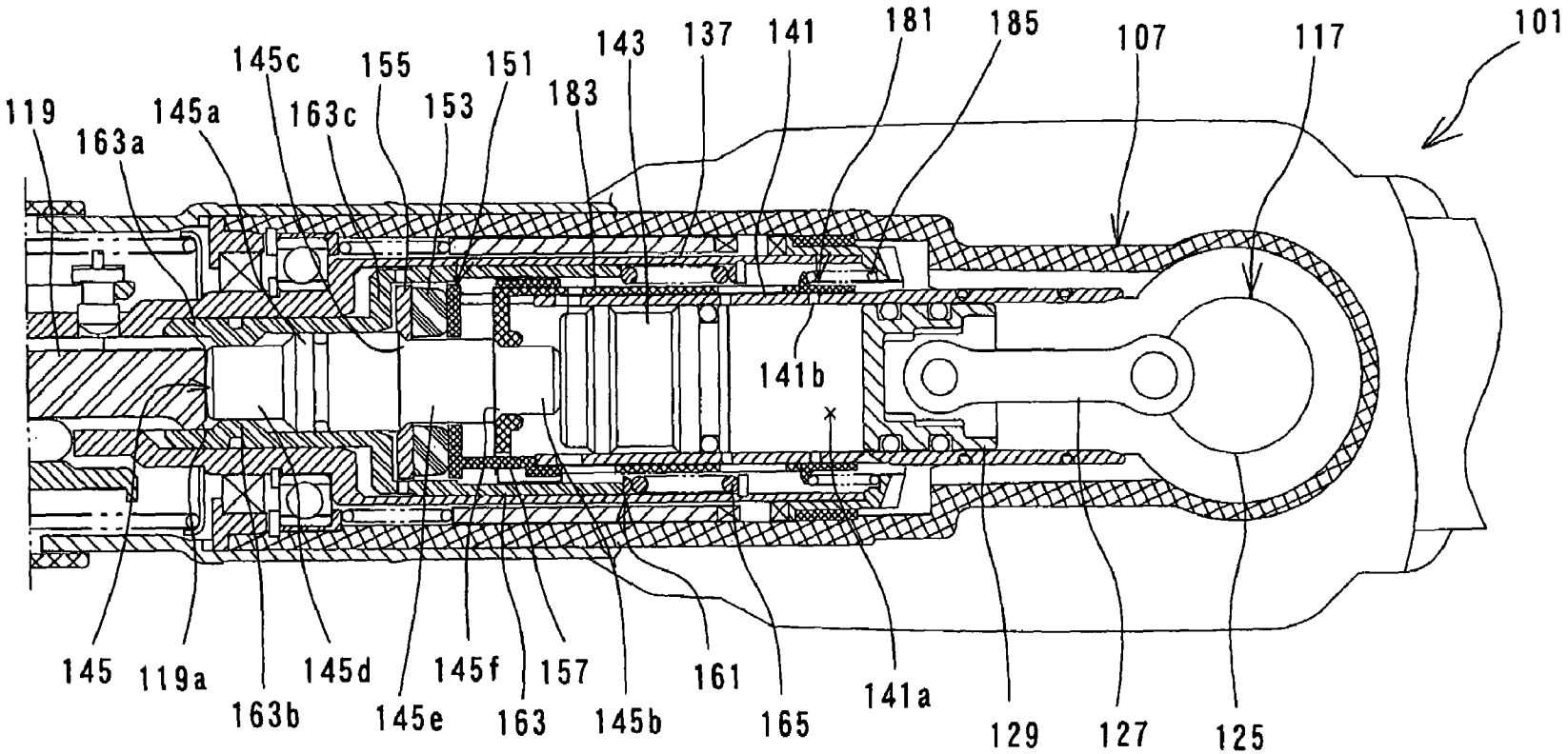
FIG. 15 is a sectional plan view showing the hammer drill of the fourth embodiment, during operation of the impact damper.

Now, a fourth representative embodiment of the present invention is described with reference to FIGS. 14 and 15. In the fourth embodiment, the reaction force caused during the striking movement is transmitted from the hammer bit 119 to the impact damper 161, while adapting an idle driving prevention mechanism. Except for these points, the fourth representative embodiment has the same construction as the first embodiment and the third embodiment. Thus, components and elements in the second embodiment which are substantially identical to those in the first and third embodiments are given like numerals as in the first and third embodiments and is not described or only briefly described.

According to the hammer drill 101 as fourth representative embodiment, under loaded conditions in which the hammer bit 119 is pressed against the workpiece, the head of the hammer bit 119 contacts the contact portion 163*b* of the cylindrical weight 163 when the hammer bit 119 and the impact bolt 145 are pushed rearward. Further, the tapered portion 145*c* of the impact bolt 145 contacts the front metal washer 155 of the positioning member 151, and the rear metal washer 157 contacts the front end of the cylinder 141. Thus, the cylinder 141 on the body 103 side receives the force of pushing in the hammer bit 119. Further, when the impact bolt 145 is pushed rearward, the rear tapered portion 145*f* of the impact bolt 145 contacts the inside flange portion 183*a* of the actuation sleeve 183 and the impact bolt 145 moves the actuation sleeve 183 rearward against the biasing force of the biasing spring 185. As a result, the actuation sleeve 183 closes the air hole 141*b* of the air chamber 141*a*, which enables the action of the air spring. This state is shown in FIG. 14.

In this state, when the driving motor 111 is driven, the hammer bit 119 is caused to rebound by the reaction force from the workpiece after the striking movement of the hammer bit 119. The reaction force of the hammer bit 119 is transmitted to the cylindrical weight 163 which is in contact with the hammer bit 119. Thus, the cylindrical weight 163 is caused to move rearward in the direction of action of the reaction force and elastically deforms the coil spring 165. As a result, the impact force caused by rebound of the hammer bit 119 is absorbed by the impact damper 161, so that vibration of the hammer drill 101 can be reduced. This state is shown in FIG. 15.

Fifth representative embodiment

Figure 16:
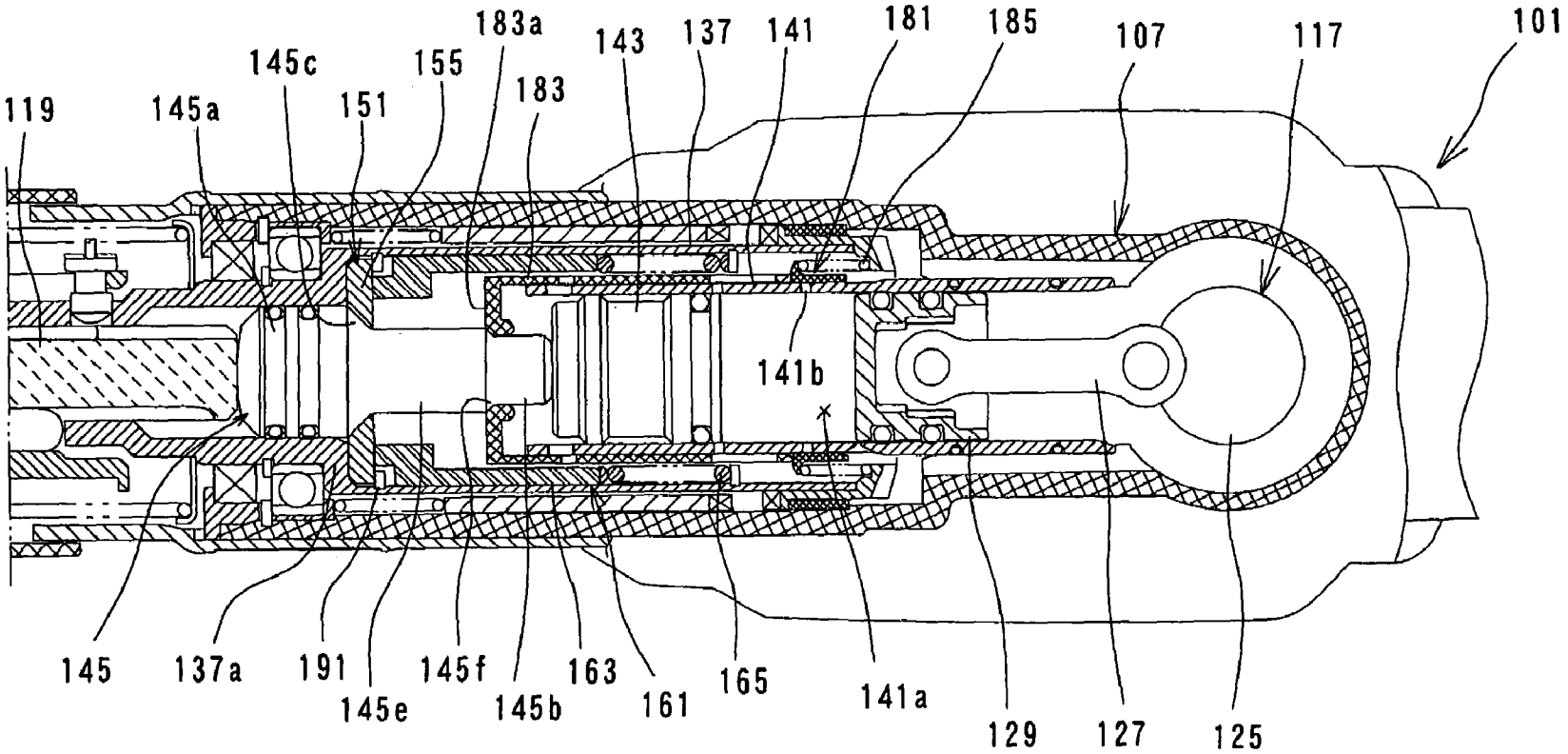
FIG. 16 is a sectional plan view showing an electric hammer drill according to a fifth embodiment of this invention, under loaded conditions in which the hammer bit is pressed against the workpiece.
Figure 17:
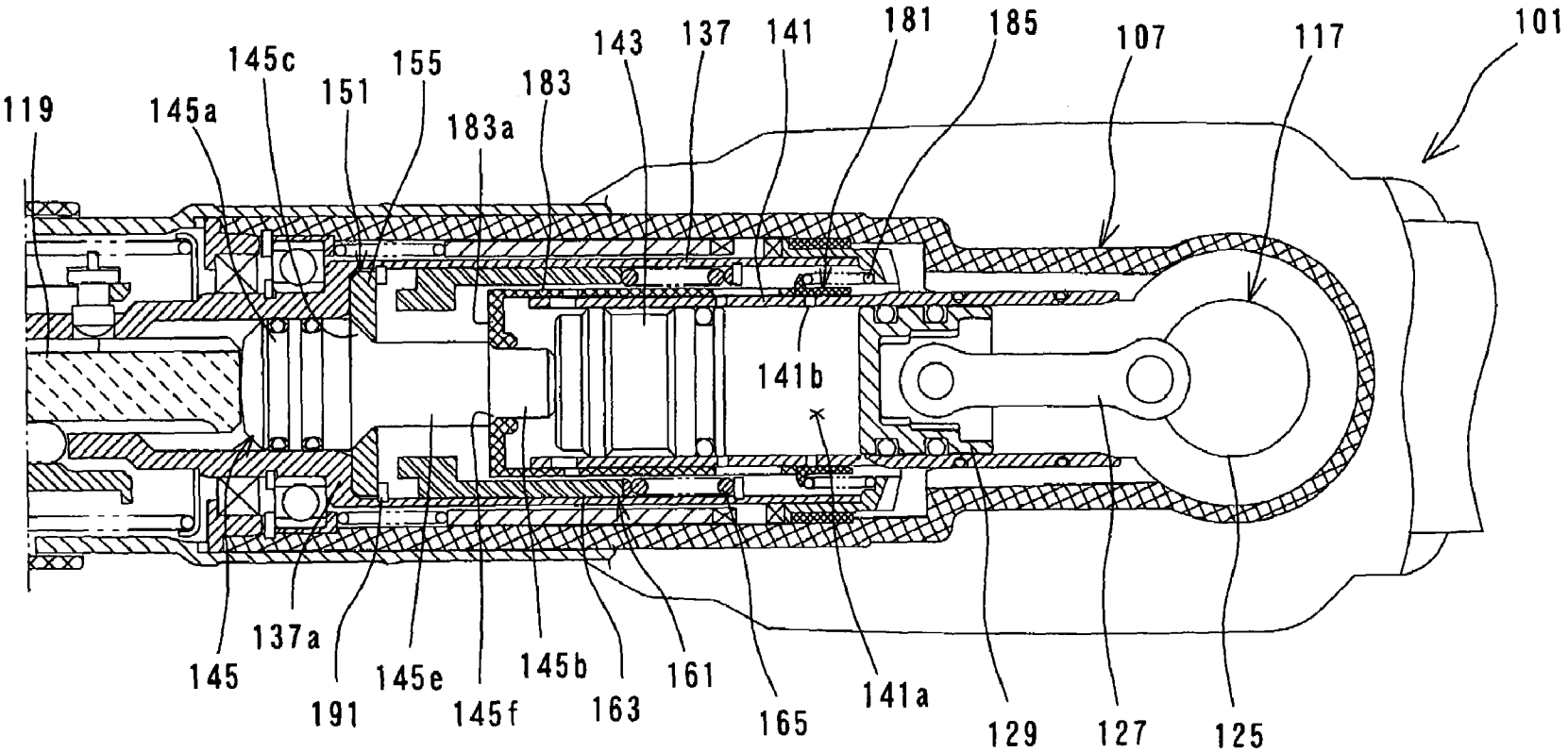
FIG. 17 is a sectional plan view showing the hammer drill of the fifth embodiment, during operation of the impact damper.

Now, a fifth representative embodiment of the present invention is described with reference to FIGS. 16 and 17. In the fifth embodiment, rubber ring 153 as the positioning member 151 is omitted from the feature described as the third representative embodiment. Except for this point, the fifth representative embodiment has the same construction as the third embodiment. Thus, components and elements in the fifth embodiment which are substantially identical to those in the third embodiment are given like numerals as in the third embodiment and is not described or only briefly described.

In this embodiment, the positioning member 151 only comprises the metal washer 155. The front surface of the positioning metal washer 155 is in contact with the inside stepped portion 137*a* of the tool holder 137 and a stopper ring 191 locks the metal washer 155 in contact with the rear surface of the metal washer 155. Specifically, the metal washer 155 is mounted in a state in which it is prevented from moving with respect to the tool holder 137 in the axial direction of the hammer bit. Under loaded conditions in which the impact bolt 145 is pushed rearward together with the hammer bit 119, as shown in FIG. 16, the metal washer 155 contacts the front tapered portion 145*c* of the impact bolt 145.

According to the fifth embodiment, under loaded conditions in which the hammer bit 119 is pressed against the workpiece, the front tapered portion 145*c* of the impact bolt 145 contacts the metal washer 155 when the hammer bit 119 and the impact bolt 145 are pushed rearward. The metal washer 155 is fixedly mounted to the tool holder 137. Therefore, the tool holder 137 on the body 103 side receives the force of pushing in the hammer bit 119. Further, when the impact bolt 145 is pushed rearward, the rear tapered portion 145*f* of the impact bolt 145 contacts the inside flange portion 183*a* of the actuation sleeve 183 and the impact bolt 145 moves the actuation sleeve 183 rearward against the biasing force of the biasing spring 185. As a result, the actuation sleeve 183 closes the air hole 141*b* of the air chamber 141*a*, which enables the action of the air spring. This state is shown in FIG. 16.

In this state, when the driving motor 111 is driven, the hammer bit 119 is caused to rebound by the reaction force from the workpiece after the striking movement of the hammer bit 119. This rebound causes the impact bolt 145 to be acted upon by a rearward reaction force. At this time, the cylindrical weight 163 of the impact damper 161 is in contact with the impact bolt 145 via the metal washer 155. Therefore, in this state of contact via the metal washer 155, the reaction force of the impact bolt 145 is transmitted to the cylindrical weight 163. The reaction force of the hammer bit 119 is transmitted to the cylindrical weight 163 which is in contact with the hammer bit 119. Thus, the cylindrical weight 163 is caused to move rearward and elastically deforms the coil spring 165. As a result, the reaction force of the cylindrical weight 163 that moves rearward is absorbed by such elastic deformation. This state is shown in FIG. 17.

At this time, the metal washer 155 is prevented from moving in the axial direction of the tool holder 137 via the stopper ring 191. Therefore, the reaction force of the impact bolt 145 may act upon the tool holder 137 via the metal washer 155. However, the metal washer 155 and the stopper ring 191 need not be in close contact with each other, but a slight clearance is allowed to be formed therebetween. On the other hand, the metal washer 155 is held in absolute contact with the cylindrical weight 163 by the biasing force of the coil spring 165. Therefore, most of the reaction force of the impact bolt 145 is transmitted to the cylindrical weight 163 which is placed in close contact with the metal washer 155. Thus, the impact force caused by rebound of the hammer bit 119 and the impact bolt 145 can be efficiently absorbed by the rearward movement of the cylindrical weight 163 and by the elastic deformation of the coil spring 165 which is caused by the movement of the cylindrical weight 163. As a result, vibration of the hammer drill 101 can be reduced. According to this embodiment, even without provision of the rubber ring 153 described in the first embodiment, it is made possible to efficiently absorb the impact force caused by rebound of the hammer bit 119 after the striking movement.

In the above-described respective representative embodiments, the hammer drill 101 is described as a representative example of the impact power tool. However, the present invention can also be applied to a hammer. In the case of a hammer in which the hammer bit 119 performs only a striking movement, the positioning member 151 that receives the pushing force of the hammer bit 119 may be secured to a housing in order to be prevented from moving in the axial direction.

Further, in the above embodiments, the reaction force is described as being transmitted via a path from the impact bolt 145 to the cylindrical weight 163 or via a path from the hammer bit 119 to the cylindrical weight 163, but it may be configured to provide the both transmission paths. Specifically, a plurality of cylindrical weights may be provided in the body 103 such that the reaction force from the impact bolt is transmitted to one of the cylindrical weights and the reaction force from the hammer bit is transmitted to another cylindrical weight. Further, the cylindrical weight 163 forming the impact damper 161 may have a shape other than a cylindrical shape. Further, a vibration reducing mechanism, such as a counter weight and a dynamic vibration reducer, which reduces vibration of the body 103 by reciprocating in the same direction as the hammer bit 119, can also be provided in this invention.

Further, in the above embodiments, a crank mechanism is described as being used as the motion converting mechanism 113 for converting the rotating output of the driving motor 111 to linear motion in order to linearly drive the hammer bit 119. However, the motion converting mechanism is not limited to the crank mechanism, but, for example, a swash plate (wobble plate) that axially swings may be utilized as the motion converting mechanism.

Further, in the above embodiments, the idle driving prevention mechanism 181 is described as being configured independently of (in parallel with) the impact damper 161 and to move between the open position to open the air hole 141*b* and the closed position to close the air hole 141*b* when the impact bolt 145 is caused to move in the axial direction. However, the idle driving prevention mechanism 181 may be configured to move via the impact damper 161. Specifically, in this case, when the user presses the hammer bit 119 against the workpiece, the impact bolt 145 is pushed to the body 103 side together with the hammer bit 119 and in turn pushes the cylindrical weight 163 of the impact damper 161. At this time, the actuation sleeve 183 of the idle driving prevention mechanism 181 is pushed rearward via the coil spring 165 to the closed position to close the air hole 141*b*. In the rearward position, the cylindrical weight 163 serves to absorb the reaction force caused by striking movement of the hammer bit 119. In other words, in such a configuration, the impact damper 161 in use is caused to move rearward together with the impact bolt 145 and moves the actuation sleeve 183 of the idle driving prevention mechanism 181 to the actuating position to enable the action of the air spring function.

Further, although the impact damper 161 and the idle driving prevention mechanism 181 are described as being arranged in parallel, it can be configured such that the actuation sleeve 183 of the idle driving prevention mechanism 181 can also be used as the cylindrical weight 163 of the impact damper 161 by appropriately adjusting the weight of the actuation sleeve 183.

DESCRIPTION OF NUMERALS

101 hammer drill (impact power tool)
103 body (tool body)
105 motor housing
107 gear housing
109 handgrip
109*a* pivot
109*b* elastic spring
111 driving motor
113 motion converting mechanism (driving mechanism)
115 striking mechanism
117 power transmitting mechanism
119 hammer bit (hammer actuating member)
119*a* head edge portion
121 driving gear
123 driven gear
125 crank plate
126 eccentric shaft
127 crank arm
128 connecting shaft
129 piston
131 transmission gear
133 transmission shaft
134 small bevel gear
135 large bevel gear
137 tool holder
137*a* inside stepped portion
141 cylinder
141*a* air chamber
143 striker
145 impact bolt (hammer actuating member)
145*a* large-diameter portion
145*b* small-diameter portion
145*c* tapered portion
145*d* small-diameter portion
145*e* medium-diameter portion
145*f* tapered portion
151 positioning member
153 rubber ring
155 front metal washer (intervening member)
157 rear metal washer
157*a* cylindrical portion
157*b* inner flange
159 spacer
161 impact damper
163 cylindrical weight (weight)
163*a* small-diameter extension
163*b* contact portion
163*c* stepped portion
165 coil spring (elastic element)
167 spring receiving ring
169 stopper (control member)
171 dynamic vibration reducer
172 cylindrical body
173 weight
174 biasing spring
175 first actuation chamber
175*a* first communicating portion
176 second actuation chamber
176*a* second communicating portion
177 crank chamber
178 cylinder accommodating space
181 idle driving prevention mechanism
183 actuation sleeve (air spring actuation member)
183*a* inside flange portion
184 biasing spring (biasing member)
191 stopper ring

I claim:

1. An impact power tool comprising:

a tool body, a hammer actuating member disposed in a tip end region of the tool body to perform a predetermined hammering operation on a workpiece by reciprocating movement in an axial direction of the hammer actuating member, an air spring, a driving mechanism that linearly drives the hammer actuating member by means of the air spring, a weight located in a reaction force transmitting position, the reaction force transmitting position being defined by a state in which the weight is placed in direct contact with the hammer actuating member or the weight is placed in contact with the hammer actuating member via direct contact with an intervening member made of hard metal, wherein a reaction force that the hammer actuating member receives from the workpiece when performing a hammering operation is transmitted from the hammer actuating member to the weight, when the weight is located in the reaction force transmitting position, an elastic element that is elastically deformed when the reaction force transmitted to the weight causes the weight to move rearward from the reaction force transmitting position and directly contact the elastic element, wherein the elastic element absorbs the reaction force and a control member that prevents an elastic force of the elastic element from displacing the weight forward beyond the reaction force transmitting position.

2. The impact power tool as defined in claim 1, further comprising an elastic member, aside from the elastic element, wherein the elastic member is disposed between the hammer actuating member and a striking mechanism that includes a cylinder fixedly mounted to a gear housing that contacts the tool body and wherein, during hammering operation, a pushing force acts upon the hammer actuating member when the hammer actuating member is pressed against the workpiece causing the hammer actuating member to move rearward and contact the elastic member such that the elastic member elastically connects the hammer actuating member to the tool body, thereby positioning the tool body with respect to the workpiece.

3. The impact power tool as defined in claim 2, wherein the weight and the elastic member are disposed along substantially parallel longitudinal axes of the hammer actuating member.

4. The impact power tool as defined in claim 2, wherein the hammer actuating member contacts the weight and the elastic member via the intervening member made of hard metal, the intervening member being disposed between the hammer actuating member and the weight and between the hammer actuating member and the elastic member.

5. The impact power tool as defined claim 2, wherein the hammer actuating member includes an impact bolt that receives a driving force of the driving mechanism, and a tool bit that is caused to reciprocate by collision with the impact bolt, and wherein the tool bit transmits the reaction force from the workpiece to the weight in the state of contact with the weight.

6. The impact power tool as defined in claim 1, wherein the control member comprises a stopper that contacts the weight to prevent the weight from moving forward beyond the reaction force transmitting position.

7. The impact power tool as defined in claim 1, wherein the hammer actuating member includes an impact bolt that receives a driving force of the driving mechanism, and a tool bit that is caused to reciprocate by collision with the impact bolt, and wherein the impact bolt transmits the reaction force from the workpiece to the weight in a state of contact with the weight.

8. The impact power tool as defined in claim 1 further comprising a vibration reducing weight, aside from said weight, wherein the vibration reducing weight is connected to the tool body to reduce vibration by reciprocating in the same direction as the hammer actuating member.

9. The impact power tool as defined in claim 1 further comprising:

an air spring actuation member switched between a non-actuating position in which the air spring is disabled to operate and an actuating position in which the air spring is enabled to operate and a biasing member that biases the air spring actuation member to be placed in the non-actuating position.

10. The impact power tool as defined in claim 9, wherein, when the hammer actuating member is pressed against the workpiece during hammering operation, the hammer actuating member is pushed rearward by the workpiece and directly pushes the air spring actuation member from the non-actuating position to the actuating position.

11. The impact power tool as defined in claim 1, wherein the intervening member is mounted between the hammer actuating member and the weight such that the intervening member does not move in an axial direction of the hammer actuating member with respect to the tool body when the hammer actuating member moves from an unloaded state to a loaded state.

* * * * *